US005116716A

United States Patent [19]

Komamura et al.

[11] Patent Number: 5,116,716

[45] Date of Patent: May 26, 1992

[54] HEAT-DEVELOPABLE COLOR PHOTOGRAPHIC MATERIAL AND IMAGE-FORMING PROCESS

[75] Inventors: Tawara Komamura; Masaru Iwagaki; Hiroyuki Kaguchi, all of Hino, Japan

[73] Assignee: Konica Corporation, Tokyo, Japan

[21] Appl. No.: 697,530

[22] Filed: Apr. 29, 1991

Related U.S. Application Data

[63] Continuation of Ser. No. 371,645, Jun. 22, 1989, abandoned, which is a continuation of Ser. No. 116,008, Oct. 30, 1987, abandoned.

[30] Foreign Application Priority Data

Nov. 6, 1986 [JP] Japan ..... 61-264192
Dec. 9, 1986 [JP] Japan ..... 61-292789

[51] Int. Cl.[5] ..... G03C 5/54; G03C 1/34; G03C 7/26

[52] U.S. Cl. ..... 430/203; 430/214; 430/216; 430/219; 430/351; 430/551; 430/613; 430/614; 430/617; 430/619

[58] Field of Search ..... 430/203, 214, 216, 219, 430/372, 351, 551, 613, 614, 615, 617, 619, 559

[56] References Cited

U.S. PATENT DOCUMENTS 4,168,976 9/1979 Campbell et al. ..... 430/213
4,584,267 4/1986 Masakawa et al. ..... 430/203
4,719,168 1/1988 Nakamura et al. ..... 430/203
4,728,600 3/1988 Hara et al. ..... 430/203
4,837,143 6/1989 Komorita et al. ..... 430/614

*Primary Examiner*—Richard L. Schilling
*Attorney, Agent, or Firm*—Frishauf, Holtz, Goodman & Woodward

[57] ABSTRACT

Disclosed is a heat-developable color photographic material containing a compound represented by Formula (1) shown below:

Formula (1)

wherein X represents a halogen atom, and Y represents a group of nonmetallic atoms necessary for forming a nitrogen-containing heterocyclic ring bearing on the ring at least one substituent having 4 or more carbon atoms.

Disclosed is also a process for forming an image on a heat-developable color photographic material, which comprises carrying out heat-development processing in the presence of the compound represented by Formula (1) mentioned above.

8 Claims, No Drawings

HEAT-DEVELOPABLE COLOR PHOTOGRAPHIC MATERIAL AND IMAGE-FORMING PROCESS

This application is a continuation of application Ser. No. 07/371,645, filed Jun. 22, 1989, now abandoned, which is a continuation of application Ser. No. 07/116,008 filed Oct. 30, 1987 (abandoned.

BACKGROUND OF THE INVENTION

This invention relates to a heat-developable color photographic material improved in image-storage stability and fog, and a process for forming an image.

Color photographic materials that can obtain simply and speedily an image by carrying out a developing step according to the dry processing with heating are known in the art, and such heat-developable color photographic materials and image-forming processes are described, for example, in Japanese Patent Publications No. 4921/1968 and No. 4924/1968; Shashin Kogaku no Kiso (The Basis of Photographic Engineering), pp.553-555 (published by Corona-sha K. K., 1979); Research Disclosure, the June 1978 issue, pp.9-15 (RD-17029); etc.

Recent years, it is also attempted to evolve heat-developable color photographic materials that can obtain a color image by using various dye providing substances. Among these prior arts, superior from viewpoints of the stability or sharpness of an image and the simpleness or rapidness of processing is the method of obtaining a color image by releasing or forming a diffusible dye by heat development and thereafter transferring the dye. The heat-developable color photographic materials and image-forming process according to this transfer method are described, for example, in Japanese Unexamined Patent Publications No. 12431/1984, No. 159159/1984, No. 181345/1984, No. 229556/1984, No. 2950/1985, No. 52643/1986, No. 61158/1986, No. 61157/1986, No. 180550/1984, No. 132952/1986 and No. 139842/1986, U.S. Pat. No. 4,595,652, U.S. Pat. No. 4,590,154 and U.S. Pat. No. 4,584,267, etc.

However, these known heat-developable color photographic materials have been disadvantageous in the storage stability of an image, particularly in that the white ground portions or the image at low density portions may be stained with lapse of time (i.e., generation of stains) or that the fogging may be highly caused.

SUMMARY OF THE INVENTION

This invention aims at eliminating the disadvantages in the above conventional heat-developable color photographic materials and image-forming processes. In other words, a first object of this invention is to provide a heat-developable color photographic material and an image-forming process that can be free from the image staining or the generation of stains at white ground portions with lapse of time. A second object of this invention is to provide a heat-developable color photographic material and an image-forming process that can decrease fogging. A still another object of this invention is to provide a heat-developable color photographic material and an image-forming process that can suppress the minimum density without causing a lowering of the maximum density of an image obtained.

The above objects of this invention can be achieved by providing a heat-developable color photographic material containing a compound represented by Formula (1) shown below or by carrying out heat-development processing in the presence of said compound.

Formula (1)

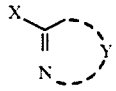

wherein X represents a halogen atom, and Y represents a group of nonmetallic atoms necessary for forming a nitrogen-containing heterocyclic ring bearing on the ring at least one substituent having 4 or more carbon atoms.

In a preferred embodiment of this invention, the above heat-developable color photographic material is a heat-developable light-sensitive material having on a support a light-sensitive silver halide, a dye providing substance, a reducing agent and a binder at least.

In a more preferred embodiment, the above heat-developable color photographic material is an image-receiving element for a diffusion transfer type heat-developable color photographic material.

DESCRIPTION OF THE PREFERRED EMBODIMENTS

In the above Formula (1), X represents a halogen atom, which may preferably be a chlorine atom. The nitrogen-containing heterocyclic ring formed by Y may preferably be a heterocyclic ring of 5 or 6 members. The nitrogen atom(s) on the heterocyclic ring may preferably comprise 1 to 3, more preferably 2 or 3, in number. The heterocyclic ring may also be condensed with another ring (for example, a benzene ring) to form a condensed ring.

The heterocyclic ring or the ring condensed to the heterocyclic ring bears on the ring at least one substituent having 4 or more carbon atoms, which substituent may include, for example, an alkyl group, an aryl group, an alkylamino group, a dialkylamino group, an arylamino group, an alkoxy group, an acylamino group, an alkylsulfone group, an aryloxy group, a carbonyl group, a sulfonyl group, a heterocyclic group, etc. These substituents may be further substituted.

Other than the above substituents, the heterocyclic ring or the ring condensed to the heterocyclic ring may be substituted on the ring with a halogen atom (preferably a chlorine atom or a fluorine atom), an amino group, a hydroxyl group, an alkyl group having less than 4 carbon atom(s), an alkylamino group, an alkoxy group or an acylamino group.

The above substituent having 4 or more carbon atoms should be selected so that the compound represented by Formula (1) can be stably dispersed in the heat-developable color photographic material. It may preferably include a group having 6 to 30 carbon atoms, and may be selected from the groups known as ballast groups in the substituents for the compounds (for example, couplers) used in conventional light-sensitive photographic materials. Preferred ballast groups are described, for example, in Japanese Patent Application No. 263564/1985.

The groups to be selected for the above purpose may additionally include a polymer residual group. When the compound has the polymer residual group as one of the substituents, the compound represented by Formula (1) may preferably be a polymer having a repeating unit derived from a monomer represented by Formula (1').

Formula (1'):

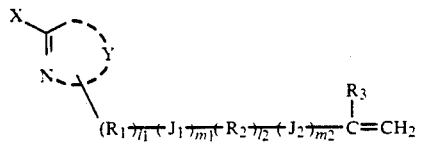

In the formula, X and Y are as defined in Formula (1). $R_1$ and $R_2$ each represent a divalent hydrocarbon group, and the divalent hydrocarbon group may include, for example, an alkylene group (for example, a methylene group, an ethylene group and a propylene group), an arylene group (for example, a phenylene group), and a group comprising a combination of any of these (for example, a methylenephenylene group). $J_1$ and $J_2$ each represent a divalent linking group, including, for example, —NHCO—, —CONH—, —COO—, —OCO—, —SCO—, —COS—, —O—, —S—, —SO—, —$SO_2$—, etc. $R_3$ represents an alkyl group (for example, a methyl group, an ethyl group, etc.) or a hydrogen atom. $l_1$, $l_2$, $m_1$ and $m_2$ each represent 1 or 0.

When the compound represented by Formula (1) is a polymer, the polymer may be a homopolymer derived from only the monomer represented by Formula (1'), or may be a copolymer with one or more additional monomer(s). The monomer used in this copolymerization may include acrylates (for example, ethyl acrylate, butyl acrylate, ethylhexyl acrylate, etc.), methacrylates (for example, methyl methacrylate, propyl methacrylate, amyl methacrylate, etc.), styrenes (for example, styrene, methylstyrene, p-sulfostyrene, etc.), acrylamides (for example, acrylamide, methyl acrylamide, butyl acrylamide, etc.), and methacrylamides (for example, methacrylamide, methyl methacrylamide, ethyl methacrylamide, etc.).

The compound represented by Formula (1) of this invention particularly preferably includes the compounds represented respectively by Formulas (A) to (I) shown below.

Formula (A):

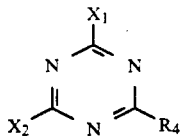

In the formula, $X_1$ and $X_2$ each represents a halogen atom, particularly preferably a chlorine atom. $R_4$ represents a ballast group having 4 or more carbon atoms or a polymer residual group.

Formula (B):

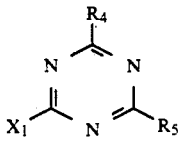

In the formula, $X^1$ and $R_4$ are the same as defined in Formula (A), $R_5$ represents a monovalent organic group which may be either a ballast group or a polymer residual group.

Formula (C):

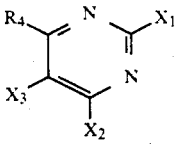

In the formula, $X^1$, $X_2$ and $R_4$ are the same as defined in Formula (A). $X_3$ represents a halogen atom, particularly preferably a chlorine atom Here, $X_1$, $X_2$ and $X_3$ may not be all like halogen atoms.

Formula (D):

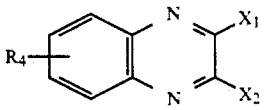

In the formula, $X_1$, $X_2$ and $R_4$ are the same as defined in Formula (A).

Formula (E):

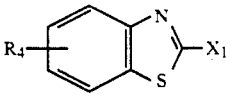

In the formula, $X_1$ and $R_4$ are the same as defined in Formula (A).

Formula (F):

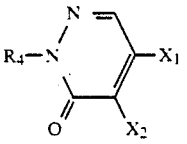

In the formula, $X_1$, $X_2$ and $R_4$ are the same as defined in Formula (A).

Formula (G):

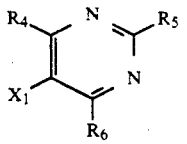

In the formula, $X_1$, $R_4$ and $R_5$ are the same as defined in Formula (B). $R_6$ has the same meaning as $R_5$.

Formula (H):

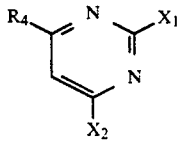

In the formula, $X_1$, $X_2$ and $R_4$ are the same as defined in Formula (A).

Formula (I):

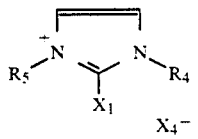

In the formula, $X_1$, $R_4$ and $R_5$ are the same as defined in Formula (B). $X_4^-$ represents an anion.

Examples of the compound represented by Formula (1) of this invention are shown below.

| Compound of the invention No. | Formulas (A) to (I) | $R_4$ | $R_5$ | $R_6$ | $X_1$ | $X_2$ | $X_3$ | $X_4^-$ |
|---|---|---|---|---|---|---|---|---|
| T-1 | (A) | $C_{10}H_{21}NH-$ | — | — | —Cl | —Cl | — | — |
| T-2 | (A) | $C_6H_{13}NH-$ | — | — | —Cl | —Cl | — | — |
| T-3 | (A) | $(C_8H_{17})_2N-$ | — | — | —Cl | —Cl | — | — |
| T-4 | (A) | $(C_4H_9)_2N-$ | — | — | —Cl | —Cl | — | — |
| T-5 | (A) | $C_{16}H_{33}NH-$ | — | — | —Cl | —Cl | — | — |
| T-6 | (A) | 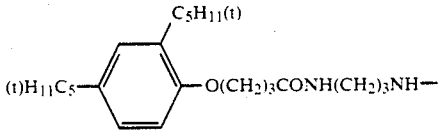 | — | — | —Cl | —Cl | — | — |
| T-7 | (A) | 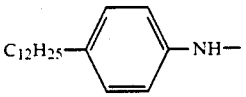 | — | — | —Cl | —Cl | — | — |
| T-8 | (A) | 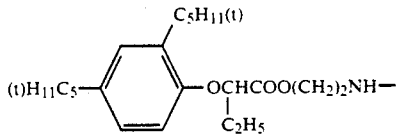 | — | — | —Cl | —Cl | — | — |
| T-9 | (A) | 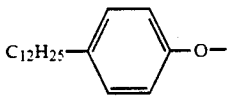 | — | — | —Cl | —Cl | — | — |
| T-10 | (A) | 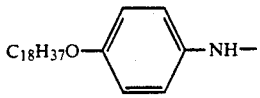 | — | — | —Cl | —Cl | — | — |
| T-11 | (B) | $C_4H_9-$ | $C_4H_9-$ | — | —Cl | — | — | — |
| T-12 | (B) | $C_4H_9-$ | $C_{10}H_{21}-$ | — | —Cl | — | — | — |
| T-13 | (C) | $C_{10}H_{21}NH-$ | — | — | —Cl | —Cl | —Cl | — |
| T-14 | (C) | $C_{10}H_{21}NH-$ | — | — | —F | —F | —Cl | — |
| T-15 | (D) | 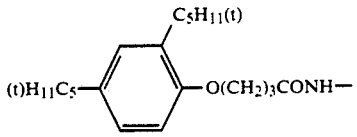 | — | — | —Cl | —Cl | — | — |

-continued

| Compound of the invention No. | Formulas (A) to (I) | $R_4$ | $R_5$ | $R_6$ | $X_1$ | $X_2$ | $X_3$ | $X_4^-$ |
|---|---|---|---|---|---|---|---|---|
| T-16 | (D) | 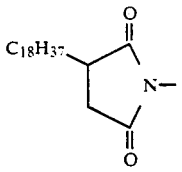 | — | — | —Cl | —Cl | — | — |
| T-17 | (D) | $C_{16}H_{33}CH(SO_3H)CONH-$ | — | — | —Cl | —Cl | — | — |
| T-18 | (E) | $C_{17}H_{35}CONH-$ | — | — | —Cl | — | — | — |
| T-19 | (E) | $C_{18}H_{37}CH(CH_2COOH)CONH-$ | — | — | —Cl | — | — | — |
| T-20 | (F) | $C_{10}H_{21}-$ | — | — | —Cl | —Cl | — | — |
| T-21 | (G) | $C_{10}H_{21}NH-$ | $CH_3SO_2-$ | $CH_3-$ | —Cl | — | — | — |
| T-22 | (B) | $C_{10}H_{21}NH-$ | $NH_2-$ | — | —Cl | — | — | — |
| T-23 | (I) | $C_{10}H_{21}-$ | $C_{10}H_{21}-$ | — | —Cl | — | — | $-Cl^-$ |

In the case the compound represented by Formula of this invention is the polymer, preferred is the polymer having a repeating unit derived from a monomer represented by the above Formula (1'), and typical examples of such a monomer represented by Formula (1') are shown below:

| Monomer No. | Formulas (A) to (I) | $R_4$ | $R_5$ | $X_1$ | $X_2$ | $X_3$ |
|---|---|---|---|---|---|---|
| MT-1 | (A) | $CH_2=C(CH_3)CONH(CH_2)_3NH-$ | — | —Cl | —Cl | — |
| MT-2 | (A) | $CH_2=C(CH_3)COO(CH_2)_2NH-$ | — | —Cl | —Cl | — |
| MT-3 | (A) | 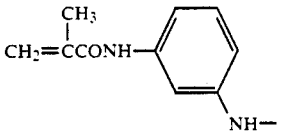 | — | —Cl | —Cl | — |
| MT-4 | (A) | 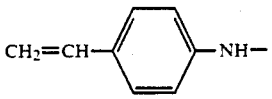 | — | —Cl | —Cl | — |
| MT-5 | (B) | $CH_2=C(CH_3)CONH(CH_2)_3NH-$ | $-NH_2$ | —Cl | — | — |
| MT-6 | (B) | $CH_2=C(CH_3)COO(CH_2)_2O-$ | $-NHC_4H_9$ | —Cl | — | — |
| MT-7 | (C) | $CH_2=C(CH_3)CONH(CH_2)_3NH-$ | — | —F | —F | —Cl |
| MT-8 | (D) | $CH_2=C(CH_3)CONH-$ | — | —Cl | —Cl | — |
| MT-9 | (E) | $CH_2=C(CH_3)CONH-$ | — | —Cl | — | — |

-continued

| Monomer No. | Formulas (A) to (I) | $R_4$ | $R_5$ | $X_1$ | $X_2$ | $X_3$ |
|---|---|---|---|---|---|---|
| MT-10 | (H) | $CH_2{=}\overset{\overset{CH_3}{\vert}}{C}CONH(CH_2)_3NH-$ | — | —Cl | — | — |

Examples of the case when the compound represented by Formula (1) is the polymer are shown below.

| Compound of the invention No. | Monomer | Copolymer | Compositional ratio (weight ratio) (monomer/copolymer) |
|---|---|---|---|
| PT-1 | MT-1 | BA | 1/1 |
| PT-2 | MT-1 | BA | 7/3 |
| PT-3 | MT-1 | EA | 3/2 |
| PT-4 | MT-1 | St | 3/2 |
| PT-5 | MT-2 | BA | 1/1 |
| PT-6 | MT-3 | BA | 3/2 |
| PT-7 | MT-4 | BA | 1/1 |
| PT-8 | MT-5 | BA | 2/3 |
| PT-9 | MT-6 | BA | 3/2 |
| PT-10 | MT-7 | MMA | 7/3 |
| PT-11 | MT-8 | BA | 3/7 |
| PT-12 | MT-8 | MA | 1/1 |
| PT-13 | MT-8 | BA | 3/2 |
| PT-14 | MT-10 | BA | 3/2 |

BA: Butyl acrylate
EA: Ethyl acrylate
St: Styrene
MMA: Methyl methacrylate
MA: Methyl acrylate Examples for the synthesis of the compound represented by Formula (1) of this invention (hereinafter called the compound of this invention) are shown below.

SYNTHESIS EXAMPLE 1

Synthesis of Exemplary Compound T-1:

In 100 ml of acetone, 18.5 g of cyanuric chloride was dissolved, and the solution was cooled to 5° C. with stirring. After addition of 10 ml of triethylamine, 18.6 g of 1-aminodecane was dropwise added at 5° C. or less. After the dropwise adding was completed, the mixture was stirred for further 1 hour, and thereafter added in 300 ml of ice water to filter the crystals precipitated, followed by further washing with cold water and cold acetonitrile. The solids thus obtained were recrystallized with use of acetonitrile to yield 15.2 g of a desired white product. All of the compounds represented by Formula (A) can be synthesized in the similar manner.

SYNTHESIS EXAMPLE 2

Synthesis of Exemplary Compound T-18:

In a solution comprising a mixture of 150 ml of acetonitrile and 20 ml of pyridine, 18 g of 2-chloro-5-aminobenzothiazole was added and dissolved, followed by dropwise adding of 50 ml of an acetonitrile solution containing 33 g of stearoyl chloride. After the dropwise adding, the reaction mixture was stirred for 1 hour at room temperature, followed by cooling to yield 39 g of white solids precipitated (the desired product).

SYNTHESIS EXAMPLE 3

Synthesis of Exemplary Compound PT-1:

In 100 ml of dry dioxane, 5 g of MT-1 and 5 g of acrylate were dissolved, and the solution was heated to 65° C. while passing nitrogen gas. While maintaining this temperature, 100 mg of azobisisobutylonitrile was added to carry out the reaction for 4 hours, followed by further addition of 100 mg of azobisisobutylonitrile to carry out the reaction for 4 hours. The reaction mixture obtained was dropwise added in ice water, and the solids precipitated were filtered and dried to yield the desired product.

SYNTHESIS EXAMPLE 4

Synthesis of Exemplary Compound PT-7:

In 50 ml of dimethylformamide, 3 g of m-aminostyrene and 6.7 g of butylacrylate were dissolved, and the solution was heated to 80° C. while passing nitrogen gas. While maintaining this temperature, 200 mg of azobisisobutylonitrile was added to carry out the polymerization reaction for 4 hours.

Separately, 4.6 g of cyanuric chloride was dissolved in 50 ml of acetone, and the solution was cooled to 10° C. with stirring, to which 3 ml of triethylamine was added, followed by the dropwise adding of the above polymerization reaction mixture. After the dropwise adding, the reaction mixture was further stirred for 2 hours, and added in 400 ml of ice water to filter the solids precipitated to yield the desired product.

The compound of this invention obtained in the above mentioned Synthesis Examples 1 to 4 were identified by NMR and FD mass spectrum that they were objective compounds respectively.

The heat-developable color photographic material of this invention can be made in any embodiment of transfer type and non-transfer type.

In the case of transfer type, it is preferred that the compound of this invention is contained in an image-receiving element.

On the other hand, in the case of non-transfer type, the compound of this invention is contained in at least one of the layers selected from light-sensitive layers and non-light-sensitive layers, but may preferably be contained in the non-light-sensitive layers of the heat-developable color photographic material, for example, an intermediate layer, a yellow filter layer and a protective layer.

The compound of this invention may preferably be a hydrophobic compound so as not to cause the reaction (for example, the hardening reaction) with a hydrophilic binder usually contained in the heat-developable color photographic material, at the time of the production, or at the time of the storage, of the heat-developable color photographic material, and may preferably added in the hydrophilic binder by solid dispersion or oil protective dispersion. Here, the hydrophobic compound is meant to be a compound having the solubility in water, of 0.1% or less at 25° C.

The compound of this invention may be contained in at least one of the layers selected from light-sensitive layers, non-light-sensitive layers and image-receiving element, according to any methods. For example, it may be used by dissolving it in a low boiling solvent (such as methanol, ethanol and ethyl acetate) and/or a high boiling solvent (such as dibutyl phthalate, dioctyl phthalate and tricresyl phosphate) followed by ultrasonic dispersion in water containing a surface active agent [and preferably further containing a hydrophilic binder (for example, gelatin or polyvinyl pyrrolidone)], or by dissolving it in an aqueous alkaline solution [for example, an aqueous 10% sodium hydroxide solution or the like preferably further containing a hydrophilic binder (for example, gelatin or polyvinyl pyrrolidone)] followed by dispersion (Fischer dispersion) by neutralization with an acid (for example, nitric acid, citric acid, etc.); or it may be used after dispersing it in an aqueous solution of a suitable hydrophilic binder (for example, gelatin or polyvinyl pyrrolidone) with use of a ball mill.

The compound of this invention is used in an amount that varies depending on the form or layer constitution of the color photographic material to be used, but may preferably be used in an amount of $1.0\times10^{-4}$ to 0.1 mol, more preferably $5.0\times10^{-4}$ to $5.0\times10^{-2}$ mol per 1 $m^2$ of the layer in which the compound is used.

The heat-developable color photographic material may preferably basically contain in a heat-developable light-sensitive layer (1) a light-sensitive silver halide, (2) a reducing agent, (3) a dye providing substance and (4) a binder, and further optionally (5) an organic silver salt. These, however, may not necessarily be contained in a single photographic component layer, and may be contained in the component layers divided into two or more layers so long as they are in such a state that the reaction can be taken place mutually. For example, the heat-developable light-sensitive layer may be divided into two layers so that the components of the above (1), (2), (4) and (5) may be contained in one of the heat-developable light-sensitive layer and the other layer contiguous to this light-sensitive layer may contain the dye providing substance (3).

The heat-developable light-sensitive layer may also be provided by dividing it into two layers or more layers comprising a high speed layer and a low speed layer or a high density layer and a low density layer.

The heat-developable color photographic material of this invention has one or two or more of heat-developable light-sensitive layer(s) on a support. In the case of color photography, it generally has three heat-developable light-sensitive layers each having a different color sensitivity, and each of the light-sensitive layers forms or releases a dye having respectively different hue, by the action of the heat development. Usually, available combinations are a yellow dye in a blue-sensitive layer, a magenta dye in a green-sensitive layer and a cyan dye in a red-sensitive layer, but may not be limited to these. It is also possible to use a combination of a near infra-red-sensitive layer.

The constitution of the respective layers can be arbitrarily selected depending on the purpose. For example, there may be taken the constitution that a red-sensitive layer, a green-sensitive layer and a blue-sensitive layer are provided in succession on a support; or, on the contrary, the constitution that a blue-sensitive layer, a green-sensitive layer and a red-sensitive layer are provided in succession on a support; or the constitution that a green-sensitive layer, a red-sensitive layer and a blue-sensitive layer are provided in succession on a support.

In addition to the above heat-developable light-sensitive layers, the heat-developable color photographic material of this invention can be provided with non-light-sensitive layers such as a subbing layer, an intermediate layer, a protective layer, a filter layer, a backing layer and a peeling layer. To provide the above heat-developable light-sensitive layers and these non-light-sensitive layers on the support by coating, there can be applied the same procedures as those used for preparing by coating the usual silver halide light-sensitive materials.

In the heat-developable color photographic material, a dye providing substance is used.

The dye providing substance of this invention may include the dye providing substance capable of forming a non-diffusible dye, as described, for example, in Japanese Unexamined Patent Publications. No. 44738/1987, No. 129852/1987 and No. 169158/1987, but preferably includes a diffusion type dye providing substance capable of forming or releasing a dissusible dye, particularly, a compound capable of forming a diffusible dye by the coupling reaction.

The dye providing substance usable in this invention will be described below. The dye providing substance may be any of those capable of participating in the reduction reaction of a light-sensitive silver halide and/or an organic silver salt optionally used, and forming or releasing a diffusible dye as a function of its reaction. It can be grouped into a negative type dye providing substance which can act on a positive function (i.e., can form a negative dye image when a negative type silver halide is used) and a positive type dye providing substance which can act on a negative function (i.e., can form a positive dye image when a negative type silver halide is used). The negative type dye providing substance can be further grouped as follows:

Negative type dye providing substance:

- Compound capable of releasing a diffusible dye when oxidized — Reducible dye releasing compound
- Compound capable of forming a diffusible dye by the coupling reaction with a reducing agent
  - Coupling dye releasing type compound
  - Coupling dye forming type compound The respective dye providing substances will be described in detail.

The reducible dye releasing compound may include, for example, a compound represented by Formula (2).

$$Car—NHSO_2—Dye \qquad \text{Formula (b 2)}$$

In the formula, Car represents a reducible substrate (the so-called carrier) undergoing oxidation to release a dye when a light-sensitive silver halide and/or an organic silver salt optionally used is reduced, and Dye represents a diffusible dye residual group.

Examples of the above reducible dye releasing compound are described in Japanese Unexamined Patent Publications No. 179840/1982, No. 116537/1983, No. 60434/1984, No. 65839/ 1984, No. 71046/1984, No. 87450/1984, No. 88730/1984, No. 123837/1984, No. 165054/1984 and No. 165055/1984, etc.

Another reducible dye releasing compound may include, for example, a compound represented by Formula (3).

Formula (3):

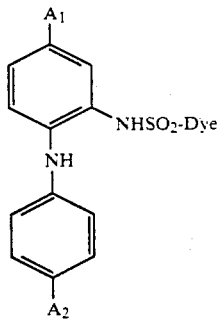

In the formula, $A_1$ and $A_2$ each represent a hydrogen atom, a hydroxyl group or an amino group; and Dye is the same as defined in Formula (2). Examples of the above compound are disclosed in Japanese Unexamined Patent Publication No. 124329/1984.

The coupling dye releasing type compound may include, for example, a compound represented by Formula (4).

$$Cp_1\text{-}(J)_{n_1}\text{-}Dye \qquad \text{Formula (4)}$$

In the formula, $Cp_1$ represents an organic group capable of releasing a diffusible dye through the reaction with an oxidized product of a reducing agent (i.e., the so-called coupler residual group), J represents a divalent linking group, and the bond between $Cp_1$ and J is cleaved through the reaction with the oxidized product of the reducing agent. $n_1$ represents 0 or 1, and Dye is the same as defined in Formula (2). The $Cp_1$ may preferably be substituted with a ballast group of every type in order to render non-diffusible the coupling dye releasing type compound, which ballast group includes organic groups having 8 or more (preferably 12 or more) carbon atoms, hydrophilic groups such as a sulfo group and a carboxyl group, or groups having 8 or more carbon atoms and a hydrophilic group such as a sulfo group and a carboxyl group together, depending on the form of a light-sensitive material to be used. Another particularly preferred ballast group may include polymer chains.

Examples of the above compound represented by Formula (4) are described in Japanese Unexamined Patent Publications No. 186744/1982, No. 122596/1982, No. 160698/1982, No. 174834/1984, No. 224883/1982, No. 159159/1984 and No. 231540/1984.

The coupling dye forming type compound may include a compound represented by Formula (5).

$$Cp_2\text{-}(F)\text{-}(B) \qquad \text{Formula (5)}$$

In the formula, $Cp_2$ represents an organic group capable of forming a diffusible dye through the reaction (coupling reaction) with an oxidized product of a reducing agent (i.e., the so-called coupler residual group), F represents a divalent linking group, and B represents a ballast group.

The coupler residual group represented by $Cp_2$ may preferably have a molecular weight of 700 or less, more preferably 500 or less, for the purpose of the diffusibility of the dye to be formed.

The ballast group may preferably include the like ballast group to the ballast group defined in Formula (4), particularly the groups having 8 or more (preferably 12 or more) carbon atoms and the hydrophilic group such as a sulfo group and a carboxyl group together, and more preferably the polymer chains.

The coupling dye forming type compound having the polymer chain may preferably include a polymer having a repeating unit derived from a monomer represented by Formula (6).

$$Cp_2\text{-}(F)\text{-}(Y)_l\text{-}(z)\text{-}(L) \qquad \text{Formula (6)}$$

In the formula, $Cp_2$ is the same as defined in Formula (5), Y represents an alkylene group, an arylene group or an aralkylene group; l represents 0 or 1; Z represents a divalent organic group; L represents an ethylenically unsaturated group or a group having an ethylenically unsaturated group.

Examples of the coupling dye forming type compounds represented respectively by Formulas (5) and (6) are described in Japanese Unexamined Patent Publications No. 124339/1984, No. 181345/1984, No. 2950/1985, No. 57943/1986, No. 59336/1986 and No. 61157/1986 (which corresponds to U.S. Pat. No. 4,631,251) and Japanese Patent Application No. 182507/1984, etc , and may include, for example, the following compounds:

Exemplary dye providing substances:

①

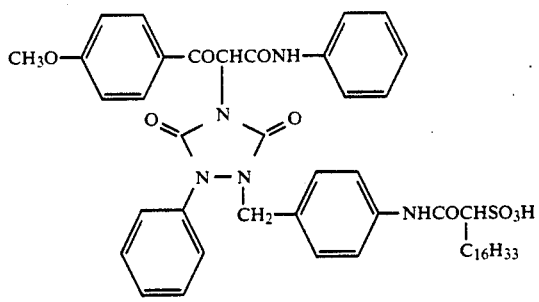

②

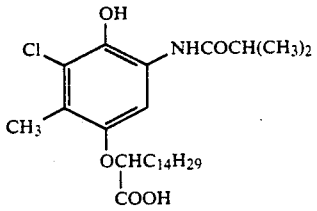

-continued
③
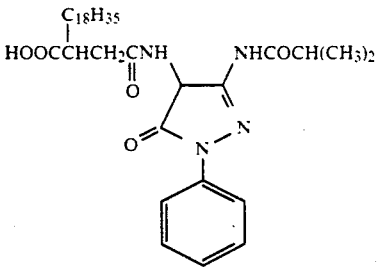
Polymer
PM-1
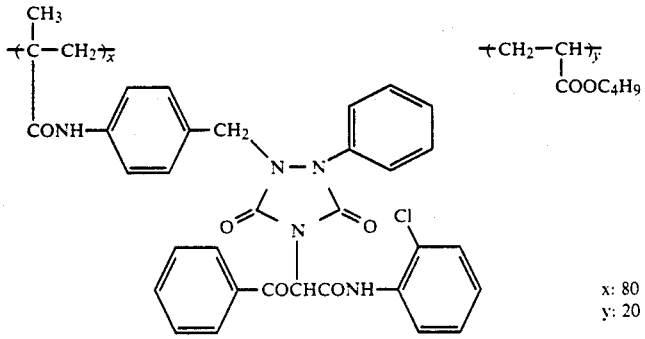
x: 80 wt. %%
y: 20 wt. %
PM-2
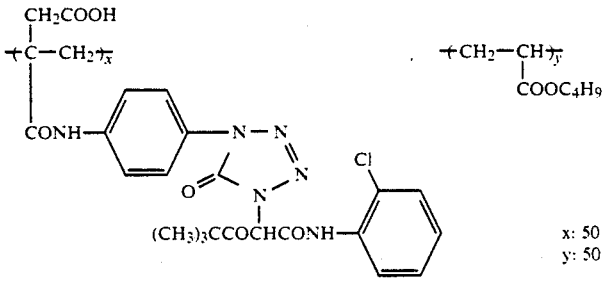
x: 50 wt. %
y: 50 wt. %
PM-3
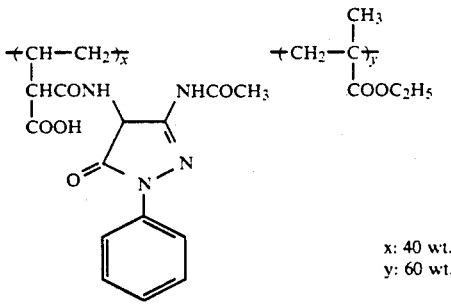
x: 40 wt. %
y: 60 wt. %
PM-4
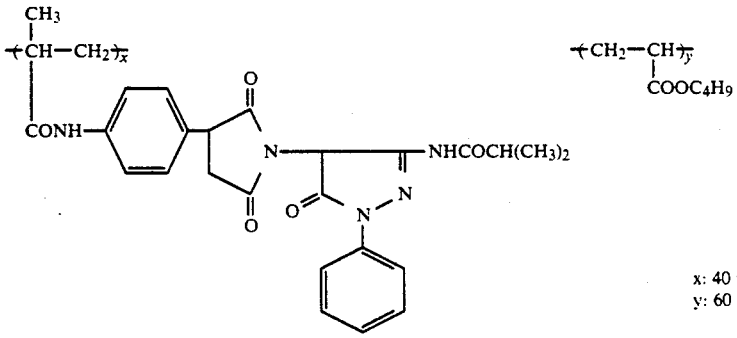
x: 40 wt. %
y: 60 wt. %

-continued
PM-5
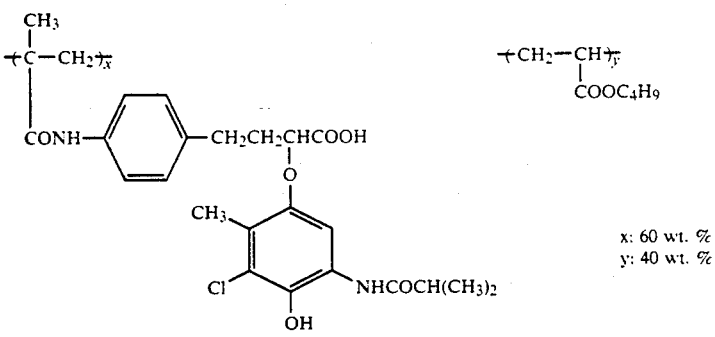
x: 60 wt. %
y: 40 wt. %
PM-6
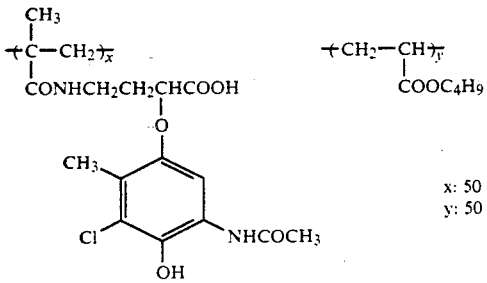
x: 50 wt. %
y: 50 wt. %
PM-7
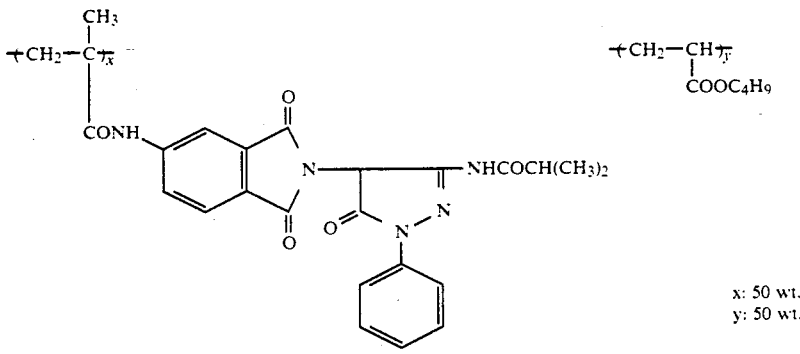
x: 50 wt. %
y: 50 wt. %
PM-8
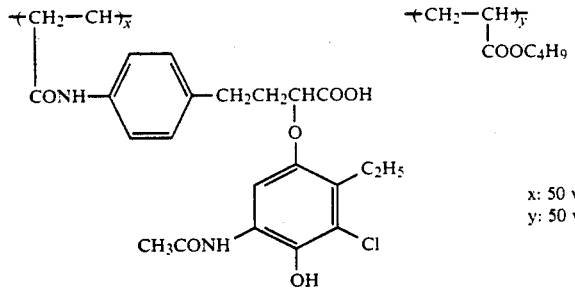
x: 50 wt. %
y: 50 wt. %
PM-9
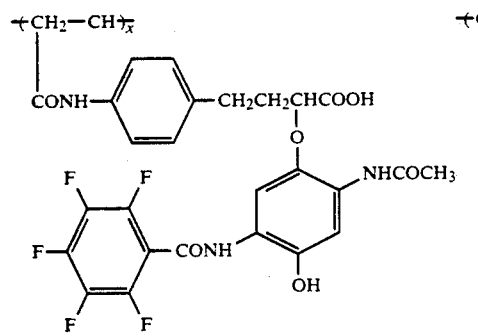
x: 50 wt. %
y: 50 wt. %

-continued
PM-10
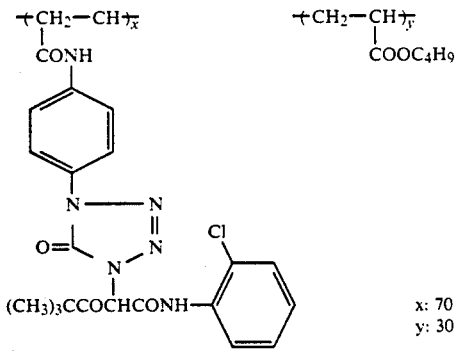
x: 70 wt. %
y: 30 wt. %
PM-11
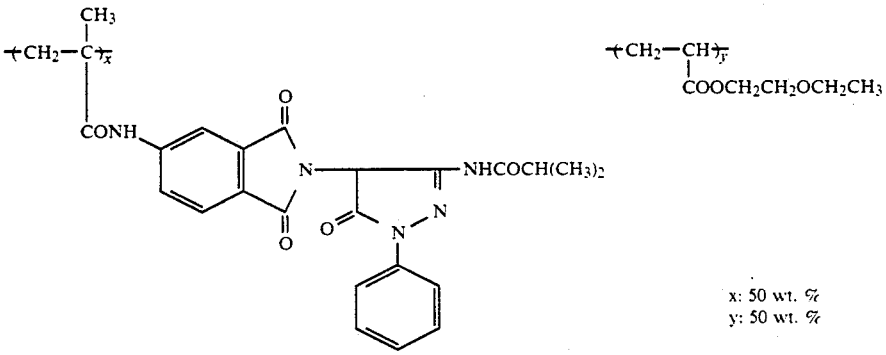
x: 50 wt. %
y: 50 wt. %
Referring in greater detail to the coupler residual groups defined by $Cp_1$ or $Cp_2$ in the above Formulas (4), (5) and (6), they may preferably include the groups represented respectively by the following formulas:
Formula (7)
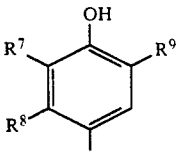
Formula (8)
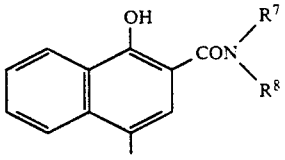
Formula (9)
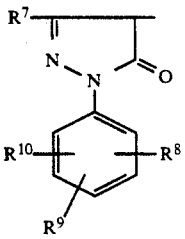
Formula (10)
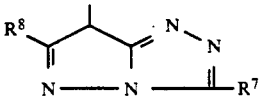
-continued
Formula (11)
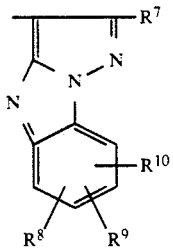
Formula (12)
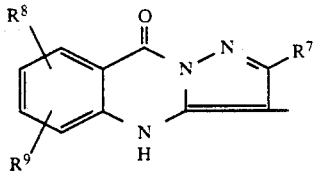
Formula (13)
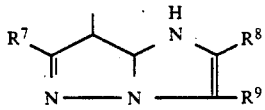
Formula (14)
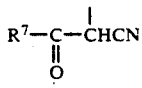
Formula (15)
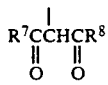

-continued

Formula (16)

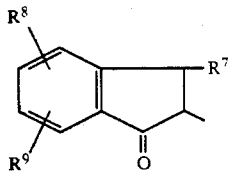

In the formulas, $R_7$, $R_8$, $R_9$ and $R_{10}$ each represent a hydrogen atom, a halogen atom, an alkyl group, a cycloalkyl group, an aryl group, an acyl group, an alkyloxycarbonyl group, an aryloxycarbonyl group, an alkylsulfonyl group, an arylsulfonyl group, a carbamoyl group, a sulfamoyl group, an acyloxy group, an amino group, an alkoxy group, an aryloxy group, a cyano group, an alkylsulfonyl group, an arylsulfonyl group, a ureido group, an alkylthio group, an arylthio group, a carboxyl group, a sulfo group or a heterocyclic residual group, and these may be further substituted with a hydroxyl group, a carboxyl group, a sulfo group, an alkoxy group, a cyano group. a nitro group, an alkyl group, an aryl group, an aryloxy group, an acyloxy group, an acyl group, a sulfamoyl group, a carbamoyl group, an imido group or a halogen atom.

These substituents may be selected depending on the purpose of $Cp_1$ and $Cp_2$. In $Cp_1$, one of the substituents may preferably be a ballast group as described above, and, in $Cp_2$, the substituent may preferably be selected so as to give a molecular weight of 700 or less, more preferably 500 or less, for the purpose of increasing the diffusibility of the dye to be formed.

The positive type dye providing substance includes an oxidative dye releasing compound represented by Formula (17) shown below.

Formula (17):

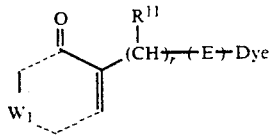

In the formula, $W_1$ represents a mass of the groups necessary for forming a quinone ring (which may have a substituent on the ring); $R_{11}$ represents an alkyl group or a hydrogen atom; E represents

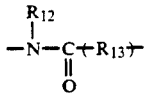

(wherein $R_{12}$ represents an alkyl group or a hydrogen atom, and $R_{13}$ represents an oxygen atom or

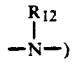

or —SO—$_2$;

r represents 0 or 1; and Dye is the same as defined in Formula (2). Examples of this compound are described in Japanese Unexamined Patent Publications No. 166954/1984, No. 154445/1984, etc.

Another positive type dye providing substance includes a compound represented by Formula (18) shown below, which loses the dye releasing ability when oxidized.

Formula (18):

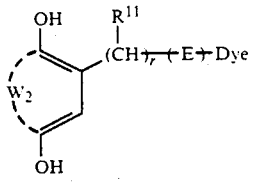

In the formula, $W_2$ represents a mass of the atoms necessary for forming a benzene ring (which may have a substituent on the ring); and $R_{11}$, r, E and Dye are the same as defined in Formula (17). Examples of this compound are described in Japanese Unexamined Patent Publications No. 124327/1984, No. 152440/1984, etc.

The positive type dye providing substance may include a compound represented by Formula (19) shown below.

Formula (19)

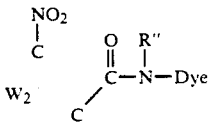

In the above formula, $W_2$, $R_{11}$ and Dye are the same as defined in Formula (18). Examples of this compound are described in Japanese Unexamined Patent Publication No. 154445/1984, etc.

The diffusible dye residual group represented by Dye in the above Formulas (2), (3), (4), (17), (18) and (19) will be described in greater detail. The residual group of the diffusible dye may preferably have a molecular weight of 800 or less, more preferably 600 or less, for the purpose of the diffusibility of the dye, and may include residual groups of azo dyes, azomethine dyes, anthraquinone dyes, naphthoquinone dyes, styryl dyes, nitro dyes, quinoline dyes, carbonyl dyes, phthalocyanine dyes, etc. These dye residual groups may be in the form that they are provisionally of a short wavelength and the color can be recovered at the time of the heat development or transfer. Also, these dye residual groups may include, as a preferred form, a dye residual group capable of being chelated as described, for example, in Japanese Unexamined Patent Publications No. 48765/1984 and No. 124337/1984, for the purpose of increasing the light fastness of an image.

These dye providing substances may be used alone, or two or more kinds of them may be used. They may be used in an amount which is not limitative and determined depending on the type of the dye providing substances, on whether they are used alone or in combination of two or more types, or on whether the photographic component layers of the color photographic material of this invention comprises a single layer or a multi-layer of two or more layers. For example, they can be used in an amount of 0.005 g to 50 g, preferably 0.1 to 10 g, per 1 $m^2$ of the layer in which the dye providing substance is contained.

The dye providing substance used in this invention may be incorporated into the photographic component layers or the image-receiving element of the heat-developable color photographic material according to any methods. For example, it may be used by dissolving it in a low boiling solvent (such as methanol, ethanol and ethyl acetate) or a high boiling solvent (such as dibutyl phthalate, dioctyl phthalate and tricresyl phosphate) followed by ultrasonic dispersion, or by dissolving it in an aqueous alkaline solution (for example, an aqueous 10% sodium hydroxide solution or the like) followed by neutralization with a mineral acid (for example, hydrochloric acid or nitric acid, etc.); or it may be used after dispersing it in an aqueous solution of a suitable polymer (for example, gelatin, polyvinyl butyral, polyvinyl pyrrolidone, etc.) with use of a ball mill.

The light-sensitive silver halide used in this invention may include silver chloride, silver bromide, silver iodide, silver chlorobromide, silver chloroiodide, silver iodobromide, silver chloroiodobromide, etc. The light-sensitive silver halide can be prepared according to any methods such as the single jet method or double jet method used in the field of the photographic techniques.

According to a preferred embodiment, there can be used a silver halide emulsion comprising a silver halide grain having a shell.

There can be further used a silver halide emulsion having a silver halide grain comprising such a multiple structure that the grain has the halogen composition different between its surface and inside, for example, a silver halide grain in which the halogen composition in a shell of a core/shell type silver halide grain is stepwise varied or continuously varied. As for its shape, there can be used those clearly having a crystal habit, such as a cube, a sphere, an octahedron, a dodecahedron and a tetradecahedron, etc., or those having no such a clear crystal habit. The silver halide of this type is described in Japanese Patent Application No. 215948/1985.

It is also possible to use a silver halide emulsion comprising a flat plate-like silver halide grain which is a grain having two parallel crystal faces, each of these crystal faces being larger in area than other mono-crystal of this grain, and having its aspect ratio, namely, the ratio of diameter to thickness of the grain, of 5 : 1 or more, as described in Japanese Unexamined Patent Publications No. 111933/1983 and No. 111934/1983, Research Disclosure No. 22534, etc.

In this invention, it is further possible to use a silver halide emulsion containing an internal latent type silver halide grain whose surface has not been fogged. The internal latent type silver halide grain whose surface has not been fogged is, as described in U.S. Pat. No. 2,592,250, U.S. Pat. No. 3,206,313, U.S. Pat. No. 3,317,322, U.S. Pat. No. 3,511,662, U.S. Pat. No. 3,447,927, U.S. Pat. No. 3,761,266, U.S. Pat. No. 3,703,584, U.S. Pat. No. 3,736,140, etc., is a silver halide grain having higher sensitivity in the inside of the silver halide grain than the sensitivity at the surface of the grain. There can be also used a silver halide emulsion comprising a silver halide grain internally having a polyvalent metallic ions, as described in U.S. Pat. No. 3,271,157, U.S. Pat. No. 3,447,927 and U.S. Pat. No. 3,531,291; a silver halide emulsion in which the grain surface of a silver halide grain containing a doping agent has been subjected to a weak chemical sensitization, as described in U.S. Pat. No. 3,761,276; or a silver halide emulsion comprising a grain having a laminated structure, as described in Japanese Unexamined Patent Publications No. 8524/1975, No. 38525/1975, etc.; and other silver halide emulsions described in Japanese Unexamined Patent Publications No. 156614/1977 and No. 127549/1980.

The light-sensitive silver halide emulsion may be chemically sensitized according to any methods available in the field of photographic techniques.

The silver halide in the above light-sensitive emulsion may be in the form of coarse grains or fine grains, preferably having a grain size of about 0.001 μm to about 1.5 μm, more preferably about 0.01 μm to about 0.5 μm, in its diameter.

In this invention, as a method for the preparation of another light-sensitive silver halide, it is also possible to allow a component for forming a light-sensitive silver salt to be present together with the organic silver salt described below so that the light-sensitive silver halide can be formed in a certain part of the organic silver salt.

These light-sensitive silver halide and component for forming the light-sensitive silver salt can be used in combination in various methods, and may preferably used in an amount of 0.01 g to 50 g, more preferably 0.1 g to 10 g, based on 1 $m^2$ of a support per one layer.

Typical spectral sensitizing dyes used in this invention may include, for example, cyanine, merocyanine, a complex cyanine (trinuclear or tetranuclear), a holopolar cyanine, styryl, hemicyanine, oxonol, etc.

These sensitizing dyes may be added in an amount of $1\times10^{-4}$ mol to 1 mol per mol of the component for forming the silver halide. More preferably, in an amount of $1\times10^{-4}$ mol to $1\times10^{-1}$ mol.

In the heat-developable color photographic material of this invention, a variety of organic silver salts can be optionally used for the purpose of increasing the sensitivity or improving the development performance.

The organic silver salt used in the heat-developable color photographic material of this invention may include silver salts of long chain aliphatic carboxylic acids as described in Japanese Patent Publication No. 4921/1968, Japanese Unexamined Patent Publications No. 52626/1974, No. 141222/1977, No. 36224/1978 and No. 37610/1978, U.S. Pat. No. 3,330,633, U.S. Pat. No. 3,794,496 and U.S. Pat. No. 4,105,451, etc.; or silver salts of carboxylic acids having a heterocyclic ring, for example, silver laurate, silver myristate, silver palmitate, silver stearate, silver arachidonate, silver behenate, silver α-(1-phenyltetrazolethio)acetate, etc.; aromatic carboxylic acid silver salts, for example, silver benzoate, silver phthalate, etc.; and silver salts of imino groups as described in Japanese Patent Publications No. 26582/1969, No. 2700/1970, No. 18416/1970 and No. 22185/1970, Japanese Unexamined Patent Publications No. 137321/1977, No. 18638/1983 and No. 118639/1983, U.S. Pat. No. 4,123,274, etc.

Besides these, there can be used silver complex compounds having a stability constant of 4.5 to 1.0 as described in Japanese Unexamined Patent Publication No. 31728/1977, and silver salts of imidazolinethione as described in U.S. Pat. No. 4,168,980.

Of the above organic silver salts, preferred are silver salts of imino groups, and particularly preferably silver salts of benzotriazole derivatives, more preferably silver salts of 5-methylbenzotriazole and derivatives thereof, sulfobenzotriazole and derivatives thereof, or N-alkylsulfamoylbenzotriazole and derivatives thereof.

The organic silver salts used in this invention may be used alone or in combination of two or more ones. The silver salts may be prepared in a suitable binder, and may be put into use as it is without separation or may be put into use by dispersing a separated silver salt in a binder according to a suitable means. The dispersion means may include a ball mill, a sand mill, a colloid mill, an oscillating mill, etc., to which, however, it may not be limited.

The silver salts can be generally prepared by a method in which silver nitrate and a starting organic compound are dissolved in water or an organic solvent, but it is also effective to optionally add a binder, to add an alkali such as sodium hydroxide to promote the dissolution of the organic compound, or to use an ammoniacal silver nitrate solution.

The organic silver salts may be used preferably in an amount of 0.01 mol to 500 mols, more preferably 0.1 mol to 100 mols, per mol of the light-sensitive silver halide. Still more preferably, it may be used in an amount of 0.3 mol to 30 mols.

The reducing agent used in the heat-developable color photographic material of this invention may be any of those usually used in the field of the heat-developable color photographic materials.

In the case the dye providing substance used in the heat-developable color photographic material of this invention comprises a dye providing substance capable of releasing or forming a diffusible dye through the coupling reaction with an oxidized product of a reducing agent as disclosed, for example, in Japanese Unexamined Patent Publications No. 186744/1982, No. 79247/1983, No. 149046/1983, No. 149047/1983, No. 124339/1984, No. 181345/1984, No. 2950/1985, etc., the reducing agent that can be used in this invention may include p-phenylenediamine type and p-aminophenol type developing agents described, for example, in U.S. Pat. No. 3,531,286, U.S. Pat. No. 3,761,270 and U.S. Pat. No. 3,764,328, Research Disclosures No. 12146, No. 15108 and No. 15127, and Japanese Unexamined Patent Publication No. 27132/1981, phosphoroamidophenol type or sulfonamidophenol type developing agents, sulfonamide aniline type developing agents, and hydrozone type color developing agents. There can also be advantageously used the color developing agent precursors described in U.S. Pat. No. 3,342,599 and U.S. Pat. No. 3,719,492, Japanese Unexamined Patent Publications No. 135628/1978 and No. 79035/1982, etc.

Particularly preferable reducing agent may include N-(P-N,N-dialkyl)phenylsulfamic acid salts described in Japanese Unexamined Patent Publication No. 146133/1981 and 227141/1987.

Two or more kinds of the reducing agents may be simultaneously used. It is also possible to use in combination a black and white developing agent for the purpose, e.g., of enhancing the development performance.

In the case the dye providing substance used in this invention, comprises a compound capable of releasing a dye through the oxidation, a compound which loses the dye releasing ability by being oxidized, a compound capable of releasing a dye by being reduced, etc. (or in the case only a silver image is imply obtained) as described in Japnese Unexamined Patent Publication No. 179840/1982, No. 58543/1983, No. 152440/1984, No. 15445/1984, etc., there can also be used the developing agent as described below.

For example, they may include phenols, sulfonamidophenols, polyhydroxybenzense, naphthols, hydroxybinaphthyls and methylenebisnaphthols, methylenebisphenols, ascorbic acids, 3-pyrazolidones, pyrazolones, hydrazones and paraphentlenediamines.

These developing agents mentioned above can also be used alone or in combination of two or more ones.

the amount of the above developing agents used in the heat-developable color photographic material of this invention depends on the type of the light-sensitive silver halide to be used, the type of the organic acid silver salts and the type of other additives, and they may be used usually in the range of 0.01 mol to 1,500 mols, preferably 0.1 mol to 200 mols, per mol of the light-sensitive silver halide.

As the binder used in the heat-developable color photographic material of this invention, there can be used, alone or in combination, synthetic polymers including polyvinyl butyral, polyvinyl acetate, ethyl cellulose, polymethyl methacrylate, cellulose acetate butyrate, polyvinyl alcohol, polyvinyl pyrrolidone, etc., and synthetic or naturally occurring polymers including gelatin, gelatin derivatives such as phthalated gelatin, cellulose derivatives, proteins, starch, gum arabic, etc. Particularly preferred is to use in combination, gelatin or a derivative thereof and a hydrophilic polymer such as polyvinyl pyrrolidone and polyvinyl alcohol, more preferably, a mixed binder comprising gelatin and polyvinyl pyrrolidone (including a copolymer of vinyl pyrrolidone with other monomer), described in Japanese Unexamined Patent Publication No. 229556/1984.

The binder may be used usually in an amount of 0.05 g to 50 g, preferably 0.1 g to 10 g, per 1 $m^2$ of the support.

Also, the binder may be used preferably in an amount of 0.1 to 10 g, more preferably 0.25 to 4 g, based on 1 g of the dye providing substance.

The support used in the heat-developable color photographic material of this invention may include, for example, synthetic plastic films such as polyethylene films, cellulose acetate films, polyethylene terephthalate films and polyvinyl chloride film; paper supports such as photographic base paper, printing paper, baryta paper and resin coated paper; and also a support obtained by coating an electron beam curable resin composition on any of these supports followed by curing.

In the heat-developable color photographic material of this invention, including further the case when said color photographic material is of the diffusion transfer type and an image-receiving element is used, a variety of thermal solvents may preferably be added in the heat-developable color photographic material and/or the image-receiving element. The thermal solvents used in this invention refer to compounds which promote the heat development and/or heat transfer. These compounds may include organic compounds having polarity as described, for example, in U.S. Pat. No. 3,347,675 and U.S. Pat. No. 3,667,959, Research Disclosure No. 17643 (XII), Japanese Unexamined Patent Publications No. 229556/1984, No. 68730/1984, No. 84236/1984, No. 191251/1985, No. 232547/1985, No. 14241/1985, No. 52643/1986, No. 78553/1987, No. 42153/1987 and No. 44737/1987, U.S. Pat. No. 3,438,776, U.S. Pat. No. 3,666,477 and U.S. Pat. No. 3,667,959, and Japanese Unexamined Patent Publications No. 19525/1976, No. 24829/1978, No. 60223/1978, No. 118640/1983 and No. 198038/1983. Those particularly useful for this invention may include, for example, urea derivatives (for example, dimethylurea, diethylurea, phenylurea, etc.), amide derivatives (for example, acetamide, benzamide, p-toluamide, p-butoxybenzamide, etc.), sulfonamide derivatives (for example, benzenesulfonamide, α-toluenesulfonamide, etc.), polyhydric alcohols (for example, 1,5-pentanediol, 1,6-hexanediol, 1,2-cyclohexanediol, pentaerythritol, trimethylolethane, etc.), or polyethylene glycols.

Of the above thermal solvents, further preferably used is a water insoluble solid thermal solvent described below.

The water insoluble solid thermal solvent refers to a compound which is solid at room temperature but turn to liquid at a high temperature (60° C. or more, preferably 100° C. or more, and particularly preferably 130° C. or more and 250° C. or less), and a compound having the ratio of inorganic/organic [Yoshio Kohda, "Yuuki Gainen-zu" (Conceptional Views of The Organic), published by Sankyo Shuppan K. K., 1984] in the range of 0.5 to 3.0, preferably 0.7 to 2.5, and particularly preferably 1.0 to 2.0.

Examples of the above water insoluble solid thermal solvent are described, for example, in Japanese Patent Applications No. 278331/1985, No. 280824/1985, etc.

The thermal solvent can be added in the layers including light-sensitive silver halide emulsion layers, intermediate layers, protective layers, and image-receiving layers of the image-receiving element, and can be used by adding it in the manner that the intended effect in each of the layers can be obtained.

The thermal solvent may be added usually in an amount of 10% by weight to 500% by weight, preferably 30% by weight to 200% by weight, of the amount of the binder.

In addition to the above respective components, various additives can be optionally contained in the heat-developable color photographic material of this invention.

A compound known as a toning agent in the heat-developable color photographic materials may be added in the heat-developable color photographic material of this invention as a development accelerator. The toning agent includes the compounds described, for example, in Japanese Unexamined Patent Publications No. 4928/1971, No. 6077/1971, No. 5019/1974, No. 5020/1974, No. 91215/1974, No. 107727/1974, No. 2524/1975, No. 67132/1975, No. 67641/1975, No. 114217/1975, No. 33722/1977, No. 99813/1977, No. 1020/1978, No. 55115/1978, No. 76020/1978, No. 125014/1978, No. 156523/1979, No 156524/1979, No. 156525/1979, No. 156526/1979, No. 4060/1980, No. 4061/1980 and No. 32015/1980, West German Patents No. 21 40 406, No. 21 41 063 and No. 22 20 618, U.S. Pat. No. 3,847,612, U.S. Pat. No. 3,782,941 and U.S. Pat. No. 4,201,582, Japanese Unexamined Patent Publications No. 207244/1982, No. 207245/1982, No. 89628/1983 and No. 193541/1983, etc.

Another development accelerator may include the compounds described in Japanese Unexamined Patent Publications No. 77550/1984 and No. 111636/1984. There can be also used the development accelerator releasing compounds described in Japanese Unexamined Patent Publication No. 159642/1986.

As an antifoggant, included are, for example, the higher aliphatics described in U.S. Pat. No. 3,645,739, the mercuric salts described in Japanese Patent Publication No. 11113/1972, the N-halides described in Japanese Unexamined Patent Publication No. 47419/1976, the mercapto compound releasable compound described in U.S. Pat. No. 3,700,457 and Japanese Unexamined Patent Publication No. 0725/1976, the arylsulfonic acids described in Japanese Unexamined Patent Publication No. 125016/1974, the lithium carboxylates described in Japanese Unexamined Patent Publication No. 47419/1976, the oxidizing agents described in British Patent No. 1,455,271 and Japanese Unexamined Patent Publication No. 101019/1975, the sulfinic acids or thiosulfonic acids described in Japanese Unexamined Patent Publication No. 19825/1978, the 2-thiouracils described in Japanese Unexamined Patent Publication No. 3223/1976, the simple body of sulfur described in Japanese Unexamined Patent Publication No. 26019/1976, the disulfide compounds and polysulfide compounds described in Japanese Unexamined Patent Publications No. 42529/1976, No. 81124/1976 and No. 149/1980, the rosin or diterpenes described in Japanese Unexamined Patent Publication No. 57435/1976, the polymer acids having a free carboxyl group or sulfonic acid group described in Japanese Unexamined Patent Publication No. 104338/1976, the thiazolinethion described in U.S. Pat. No. 4,138,265, the 1,2,4-triazole or 5-mercapto-1,2,4-triazole described in Japanese Unexamined Patent Publication No. 51821/1979 and U.S. Pat. No. 4,137,079, the thiosulfinic acid esters described in Japanese Unexamined Patent Publication No. 140833/1980, the 1,2,3,4-thiatriazoles described in Japanese Unexamined Patent Publication No. 142331/1980, the dihalogen compounds or trihalogen compounds described in Japanese Unexamined Patent Publications No. 46641/1984, No. 57233/1984 and No. 57234/1984, the thiol compounds described in Japanese Unexamined Patent Publication No. 111636/1984, the hydroquinone derivatives described in Japanese Unexamined Patent Publication No. 198540/1985, the combination of hydroquinone derivatives with benzotriazole derivatives described in Japanese Unexamined Patent Publication No. 227225/1985, etc.

Another particularly preferable antifoggant may further include the inhibitors having a hydrophilic group, described in Japanese Patent Application No. 78554/1987, the polymer inhibitors described in Japanese Unexamined Patent Publication No. 121452/1987, and the inhibitor compounds having a ballast group, described in Japanese Unexamined Patent Publication No. 123456/1987.

An inorganic or organic base or a base precursor can be further added. The base precursor may include a compound capable of undergoing decarboxylation by heating to release a basic substance (for example, guanidinium trichloroacetate), a compound capable of undergoing decomposition through the reaction such as intramolecular nucleophilic substitution to release amines, etc., and may include, for example, the base releasing agents described in Japanese Unexamined Patent Publications No. 130745/1981 and No. 132332/1981, British Patent No. 2,079,480, U.S. Pat. No. 4,060,420, Japanese Unexamined Patent Publications No. 157637/1984, No. 166943/1984, No. 180537/1984, No. 174830/1984 and No. 195237/1984, etc.

Besides these, there may be included various additives optionally used in the heat-developable color photographic materials, for example, anti-halation dyes, brightening agents, hardening agents, antistatic agents, plasticizers, spreading agents, matting agents, surface active agents, color-fading preventive agents, etc., which are specifically described in Research Disclosure Vol. 170, June 1978, No. 17029, Japanese Patent Application No. 135825/1987, etc.

The heat-developable color photographic material of this invention can be developed only by heating it, after imagewise exposure, for 1 second to 180 seconds, preferably 1.5 second to 120 seconds in the temperature range of 80° C. to 200° C., preferably 100° C. to 170° C. The diffusible dye may be transferred to the image-receiving layer simultaneously with the heat development by bringing the light-sensitive layer face of the color photographic material into close contact with the image-receiving layer of the image-receiving element at the time of the heat development, or may be transferred by bringing it into close contact with the image-receiving element after the heat-development followed by heating, or by bringing the former into close contact with the latter after the feeding of water optionally followed by heating. Also, preheating may be applied before exposure in the temperature range of 70° C. to 180° C. In order to enhance the mutual close contact, the color photographic material and the image-receiving element may also be respectively preheated at a temperature of 80° C. to 250° C. immediately before the heat development transfer.

In the heat-developable color photographic material according to this invention, various exposure means can be used.

As to the heating means, all of the methods that can be applied in usual heat-developable color photographic materials can be used. For example, the color photographic materials may be brought into contact with a heated block or plate, may be brought into contact with a heat roller or heat drum, or may be passed through a high temperature atmosphere. Alternatively, there may be employed high frequency heating, or it is further possible to provide a conductive layer containing a conductive material such as carbon, on the back surface of the color photographic material of this invention or the back surface of the image-receiving element for the heat transfer to utilize the Joule heat generated by energizing. There is no particular limitation in the heating pattern, and it is possible to employ a method of previously preheating and thereafter again heated, as well as a method in which the heating is carried out for a short time at a high temperature, or for a long time at a low temperature, continuously raising and lowering the temperature or repeating these. It is also possible to carry out discontinuous heating. Preferred, however, is to employ a simple pattern. There may be also employed a system in which the exposure and the heating proceed simultaneously.

In this invention, it is preferred that the heat-developable color photographic material is a diffusion transfer type color photographic material. In the case of diffusion transfer type color photographic material, image-receiving element is essential. Also, the compound of this invention represented by Formula (1) can be contained in any of image-receiving element and light-sensitive layer, i.e. light-sensitive element, but preferably in the image-receiving element.

The image-receiving element of this invention may have a structure which has substantially at least a layer (a dye-receiving layer) comprising a compound (a dye-receiving material) having the function of receiving a dye on a support. Also, said support may serve a dye-receiving material as well. Further, the support which is the same as the support of the light-sensitive element of the diffusion transfer type heat-developable color photographic material may have a dye-receiving layer thereon and may serve a dye-receiving material as well.

Moreover, a opaque layer (a reflective layer) may optionally be provided to the light-sensitive element, and said layer is used for reflecting a desired reflection, e.g. visible light, which may be used for observing dye images of the dye-receiving layer. The opaque layer (a reflective layer) may contain various agents, e.g. titanium dioxide, which can give a necessary reflection.

The image-receiving element can also be formed in the type such that it is peeled from the light-sensitive element.

For example, it is also possible to lay the image-receiving element on the light-sensitive element to overlap each other and carry out uniform heat-development, after the imagewise exposure of the light-sensitive element of the diffusible transfer type heat-developable color photographic material. Alternatively, it is also possible to overlap the light-sensitive element and the image-receiving element after the imagewise exposure and uniform heat development of the light-sensitive element were carried out, and heating them at a temperature lower than the development temperature to transfer a diffusible dye image.

A dye-receiving layer may optionally contain a binder and various additives in addition to the compound of this invention.

The image-receiving layer of the image-receiving element effectively used in this invention may have the function of receiving a dye present in a heat-developable light-sensitive layer, released or formed by the heat development, and there is preferably used, for example, a polymer containing a tertiary amine or quaternary ammonium salt, which is a dye-receiving substance described in U.S Pat. No. 3,709,690. A typical image-receiving layer for use in the diffusion transfer can be formed by mixing the polymer containing an ammonium salt, tertiary amine or the like with gelatin, polyvinyl alcohol or the like, and coating the resulting mixture on a support. Another useful dye-receiving substance may include those comprised of a heat-resistant organic polymer having a glass transition point of not less than 40° C. and not more than 250° C., described in Japanese Unexamined Patent Publication No. 207250/1982.

These polymers may be supported on the support as the image-receiving layer, or the polymer itself may be used as the support.

Examples of the above heat-resistant organic polymers may include polyacetals such as polystyrene, polystyrene derivatives comprising a substituent having 4 or less carbon atom(s), polyvinyl cyclohexane, polydivinyl benzene, polyvinyl pyrrolidone, polyvinyl carbazole, polyallyl benzene, polyvinyl alcohol, polyvinyl formal and polyvinyl butyral; polyesters such as polyvinyl chloride, chlorinated polyethylene, polyethylene trichloride fluoride, polyacrylonitrile, poly-N,N-dimethylallylamide, polyacrylate having a p-cyanophenyl group, a pentachlorophenyl group or a 2,4-dichlorophenyl group, polyacryl chloroacrylate, polymethyl methacrylate, polyethyl methacrylate, polypropyl methacrylate, polyisopropyl methacrylate, polyisobutyl methacrylate, poly-tert-butyl methacrylate, polycyclohexyl methacrylate, polyethylene glycol dimethacrylate, poly-2-cyano-ethyl methacrylate and polyethylene terephthalate; polycarbonates such as polysulfone and bisphenol A polycarbonate; polyanyhydrides; polyamides; and cellulose acetates. Also useful are the synthetic polymer having a glass transition point of 40° C. or more, described in Polymer Handbook, 2nd Edition (edited by J. Brandrup and E. H. Immergut), published by John Willey & Sons. In general, a useful molecular weight of the above polymer is 2,000 to 200,000. These polymers may be used alone or as a blend of two or more ones, or may be used as a copolymer comprising the combination of two or more ones.

Useful polymers may include cellulose acetates such as triacetate and diacetate; polyamides comprising the combination of heptamethylenediamine with terephthalic acid, fluorenedipropylamine with adipic acid, hexamethylene diamine with diphenic acid, hexamethylenediamine with isophthalic acid or the like; polyesters comprising the combination of diethylene glycol with diphenylcarboxylic acid, bis-p-carboxyphenoxybutane with ethylene glycol or the like; polyethylene terephthalate; and polycarbonate. These polymers may be modified. For example, also effective is polyethylene terephthalate using cyclohexanedimethanol, isophthalic acid, methoxypolyethylene glycol, 1,2-dicarbomethoxy-4-benzenesulfonic acid or the like as a modifier.

Particularly preferable image-receiving layer may include the layer comprising polyvinyl chloride, described in Japanese Unexamined Patent Publication No. 223425/1984, and the layer comprising polycarbonate and a plasticizer, described in Japanese Unexamined Patent Publication No. 19138/1985.

Using these polymers, an image-receiving layer also serving as a support may be provided In that instance, the support may be formed of a single layer or may be formed of a plural number of layers.

The compound of this invention may preferably added to the above image-receiving layer. It may be added preferably in an amount of $1.0\times10^{-4}$ to 0.1 mol, more preferably $5.0\times10^{-4}$ to $5.0\times10^{-2}$, per 1 $m^2$ of the image-receiving layer.

As the support for the image-receiving element, there may be used any of transparent supports, opaque supports and so forth, including, for example, films made of polyethylene terephthalate, polycarbonate, polystyrene, polyvinyl chloride, polyethylene, polypropylene, etc., and a support obtained by incorporating a pigment such as titanium oxide, barium sulfate, calcium carbonate and talc into any of these supports, or baryta paper, RC paper obtained by laminating on a sheet of paper a thermoplastic resin containing a pigment, cloths, glass, metals such as aluminum, a support obtained by coating on any of these supports an electron beam curable resin composition containing a pigment followed by curing, and a support comprising a coating layer containing a pigment and provided on any of these supports. The cast coat paper described in Japanese Patent Application No. 126972/1986 is also useful as the support.

In particular, a support obtained by coating on paper an electron beam curable resin composition containing a pigment followed by curing, or a support obtained by providing a pigment-coated layer on paper and coating on the pigment-coated layer an electron beam curable resin composition followed by curing, whose resin layer can be used as the image-receiving layer by itself, can be used as the image-receiving element as it is.

The heat-developable color photographic material of this invention can be the so-called mono sheet type heat-developable color photographic material, which is obtained by providing a light-sensitive layer and an image-receiving layer on the same support, as described in Research Disclosure No. 15108, Japanese Unexamined Patent Publications No. 198458/1982, No. 207250/1982 and No. 80148/1986.

The heat-developable color photographic material of this invention may preferably be provided with a protective layer.

In the protective layer, all sorts of additives used in the field of photography can be used. Such additives may include all sorts of matting agents, colloidal silica, lubricants, organic fluoro compounds (in particular, fluorine type surface active agents), antistatic agents, ultraviolet absorbents, high-boiling organic solvents, antioxidants, hydroquinone derivatives, polymer latex, surface active agents (containing polymeric surface active agents), hardening agents (containing polymeric hardening agents), organic silver salt grains, non-light-sensitive silver halide grains, etc.

These additives are described in Research Disclosure Vol. 170, June 1978, No. 17029, and Japanese Unexamined Patent Publication No. 135825/1987.

As described above, in the image-receiving element for the heat-developable color photographic material of this invention, the minimum density can be suppressed without causing a lowering of the maximum density, and there occurs less image staining even under the condition of time lapse when the color photographic materials stood exposed to light, temperature, humidity, etc. In particular, the stain at white ground portions can be suppressed and the generation of fog can be decreased. There also occurred only a little lowering of the image density by light, and also was shown excellence in the green storage stability.

This invention will be described below in greater detail by specific working examples, but by no means limited to these embodiments.

EXAMPLE 1

PREPARATION OF SILVER IODOBROMIDE EMULSION

At 50° C., in solution (A) in which 20 g of ossein gelatin, 1,000 ml of distilled water and ammonia were dissolved using a mixture stirrer disclosed in Japanese Unexamined Patent Publications No. 92523/1982 and No. 92524/1982, solution (B) comprising 500 ml of an aqueous solution containing 11.6 g of potassium iodide and 131 g of potassium bromide and solution (C) comprising 500 ml of an aqueous solution containing 1 mol of silver nitrate and ammonia were simultaneously added while keeping pAg to a constant level. The shape and size of the emulsion grains to be prepared were regulated by controlling the pH, pAg and addition rate of solution (B) and solution (C). prepared in this manner was a core emulsion having a silver iodide content of 7 mol. %, comprising a regular octahedron and having an average grain size of 0.25 μm.

Next, in the same manner as in the above, a shell comprising silver halide having silver iodide content of 1 mol % was covered to prepare a core/shell type silver halide emulsion comprising a regular octahedron and having an average grain size of 0.3 μm (the monodispersity was found to be 9%). The emulsion thus prepared was subjected to washing with water and desalting. The emulsion was yielded in 800 ml.

Prepared further were light-sensitive silver halide emulsions in the following manner with use of the silver iodobromide emulsion prepared in the above.

a) Preparation of red-sensitive silver iodobromide emulsion:

| | |
|---|---|
| The above silver iodobromide emulsion | 700 ml |
| 4-Hydroxy-6-methyl-1,3,3a,7-tetrazaindene | 0.4 g |
| Gelatin | 32 g |
| Sodium thiosulfate | 10 mg |

-continued

| | |
|---|---|
| 1% Methanol solution of sensitizing dye (a) shown below | 80 ml |
| Distilled water | 1,200 ml |

Sensitizing dye (a):

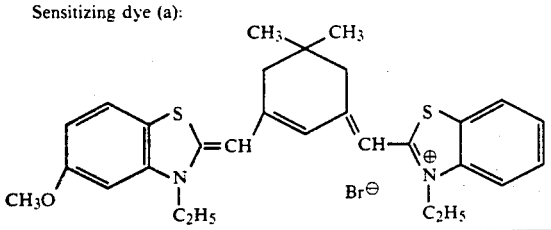

b) Preparation of green-sensitive silver iodobromide emulsion:

| | |
|---|---|
| The above silver iodobromide emulsion | 700 ml |
| 4-Hydroxy-6-methyl-1,3,3a,7-tetrazaindene | 0.4 g |
| Gelatin | 32 g |
| Sodium thiosulfate | 10 mg |
| 1% Methanol solution of sensitizing dye (b) shown below | 80 ml |
| Distilled water | 1,200 ml |

Sensitizing dye (b):

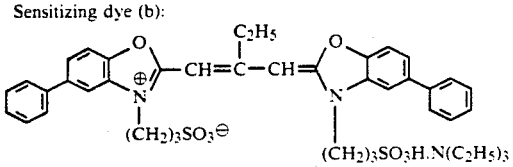

c) Preparation of blue-sensitive silver iodobromide emulsion:

| | |
|---|---|
| The above silver iodobromide emulsion | 700 ml |
| 4-Hydroxy-6-methyl-1,3,3a,7-tetrazaindene | 0.4 g |
| Gelatin | 32 g |
| Sodium thiosulfate | 10 mg |
| 1% Methanol solution of sensitizing dye (c) shown below | 80 ml |
| Distilled water | 1,200 ml |

Sensitizing dye (c):

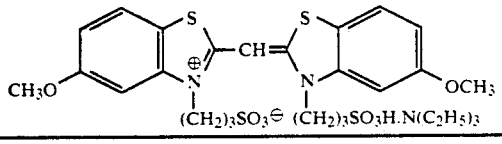

PREPARATION OF ORGANIC SILVER SALT DISPERSION 28.8 g of 5-methylbenzotriazole silver obtained by reacting 5-methylbenzotriazole with silver nitrate in a water/alcohol mixed solvent, 16.0 g of poly(N-vinyl pyrrolidone) and 1.33 g of 4-sulfobenzotriazole sodium salt were dispersed with use of an alumina ball mill and made up to 200 ml with pH 5.5.

PREPARATION OF DYE PROVIDING SUBSTANCE DISPERSION

In 300 ml of ethyl acetate, 112 g of exemplary dye providing substance (PM-7), 4.0 g of the hydroquinone compound shown below and 1.0 g of the antifoggant shown below were dissolved, and the resulting solution was mixed with 248 of an aqueous solution containing 5% by wight of Alkanol XC (available from Du Pont Co.) and 1440 ml of an aqueous gelatin solution containing 26.4 g of photographic gelatin and 34.6 g of phenylcarbamoyl-incorporated gelatin (Luthlow Co., Type 17819 PC), followed by dispersion with use of an ultrasonic homogenizer. After ethyl acetate was evaporated, the dispersion was made up to 1590 ml with pH of 5.5.

Hydroquinone compound:

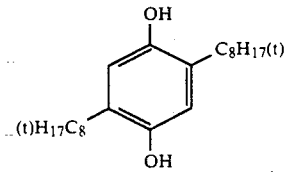

Antifoggant:

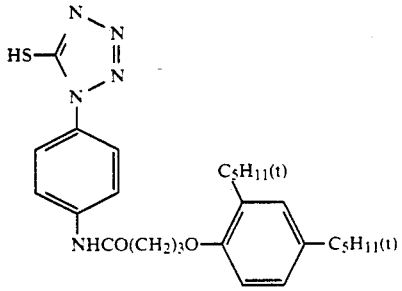

PREPARATION OF REDUCING AGENT SOLUTION

Using 65.2 g of reducing agent (1) shown below, 28.0 g of reducing agent (2) shown below, 207 ml of an aqueous solution containing 20 wt. % of polyvinyl pyrrolidone (K-30), 40 ml of an aqueous solution containing 5 wt. % of the surface active agent shown below, water, and an aqueous citric acid solution, the solution was made up to 600 ml with pH 7.0.

Surface active agent:

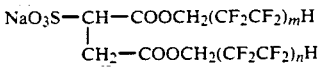

(m and n each represent 2 or 3)

Reducing agent (1):

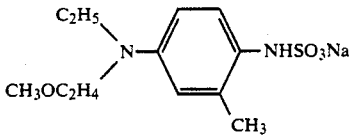

Reducing agent (2):

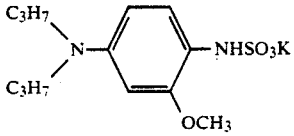

PREPARATION OF THERMAL SOLVENT DISPERSION 430 g of a thermal solvent p-n-butoxybenzamide and 1,410 ml of an aqueous solution containing 1.0 wt. % of polyvinyl pyrrolidone (K-30) were dispersed in a ball mill to obtain a dispersion of the thermal solvent.

PREPARATION OF HEAT-DEVELOPABLE COLOR PHOTOGRAPHIC MATERIAL

On a photographic transparent polyethylene terephthalate film of 180 μm thick having a subbing layer, the coating solution shown below was coated in a wet film thickness of 125 μm, followed by drying to form a heat-developable light-sensitive layer.

| (Composition of coating solution) | |
|---|---|
| Organic silver salt dispersion | 64 ml |
| Green-sensitive silver iodobromide emulsion solution | 30.7 ml |
| Reducing agent solution | 38.4 ml |
| Thermal solvent dispersion | 94.8 ml |
| Dye providing substance dispersion | 101 ml |
| Aqueous 10 wt. % photographic gelatin solution | 21.1 ml |
| Aqueous 10 wt. % phenylcarbamoyl-introduced gelatin solution | 27.7 ml |
| Aqueous citric acid solution and water (adjusting the pH of the coating solution to 5.5) | 82.3 ml |
| Solution obtained by reacting tetra(vinylsulfonylmethyl)methane with thauline in 1:1 (weight ratio) and controlled to contain 3% by weight of tetra(vinylsulfonylmethyl)methane | 20 ml |
| Total | 480 ml |

On the upper layer of the above light-sensitive layer, a protective layer having the composition shown below was coated to have a wet film thickness of 40 μm to produce a color photographic material (sample No. 1)

| (Composition of coating solution) | |
|---|---|
| Dispersion shown below, of compound (T-1) of this invention | 44.1 ml |
| The above reducing agent solution | 5.1 ml |
| The above thermal solvent dispersion | 25 ml |
| Aqueous 10 wt. % photographic gelatin solution | 25 ml |
| Aqueous citric acid solution and water (adjusting the pH of the coating solution to 5.5) | 53.3 ml |
| Solution obtained by reacting tetra(vinylsulfonylmethyl)methane with thauline in 1:1 (weight ratio) and controlled to contain 3% by weight of tetra(vinylsulfonylmethyl)methane | 7.5 ml |
| Total | 160 ml |

PREPARATION OF DISPERSION OF COMPOUND (T-1) OF THIS INVENTION

In 45 ml of ethyl acetate, 15 g of T-1 and 7.5 g of dioctyl phthalate were dissolved, and the resulting solution was mixed with 36 ml of an aqueous solution containing 5% by weight of Alkanol XC (available from Du Pont Co.), 135 ml of an aqueous solution containing 10% by weight of photographic gelatin and 80 ml of water, followed by dispersion with use of an ultrasonic homogenizer. After ethyl acetate was evaporated, the dispersion was made up to 295 ml by adding water.

PRODUCTION OF IMAGE-RECEIVING ELEMENT

An ethylene chloride solution of polycarbonate (molecular weight: 25,000; L-1250, available from Teijin Chemicals Ltd.) was coated on photographic baryta paper and dried to produce image-receiving element 1 so as to have 15.0 g/m$^2$ of polycarbonate.

Also produced was image-receiving element 2 comprising baryta paper (amount: 15.0 g/m$^2$) coated thereon with polycarbonate containing compound T-1 of this invention (amount: $1.5\times10^{-3}$ mol/m$^2$).

EVALUATION ON COLOR PHOTOGRAPHIC MATERIAL

Color photographic material No 1 obtained in the above manner was subjected to green color exposure of 800 CMS through a step wedge.

Next, the polycarbonate-coated face of each of the above image-receiving elements (1 and 2) and the light-sensitive layer face of the above color photographic material No 1 having been subjected to the exposure were overlapped each other, and the heat development was carried out for 90 seconds at 150° C., followed by peeling of the image-receiving element to obtain a transferred sharp magenta image on the image-receiving element (Transferred image samples No. 1 and No. 2). Maximum density ($D_{max}$) and fog density ($D_{min}$) of the resulting magenta images are shown in Table 1.

EXAMPLE 2

Produced were color photographic materials (sample Nos. 2 to 8) in which the compound of this invention, added in the protective layer of color photographic material No. 1 of Example 1, and the amount thereof were varied as shown in Table 1, and, as comparative examples, a color photographic material in which only the compound of this invention was removed from the protective layer (sample No. 9) and a color photographic material from which the protective layer was removed (sample No. 10).

Exposure and heat development same as in Example 1 were carried out on the resulting color photographic materials $D_{max}$ and $D_{min}$ of the magenta images of the resulting transferred image samples (Nos. 3 to 20) are shown in Table 1.

TABLE 1

| Transferred image sample No. | Color Photographic material sample No. | Image-receiving element sample No. | Compound of the invention | Amount mol/m$^2$ | $D_{max}$ | $D_{min}$ |
|---|---|---|---|---|---|---|
| 1 | 1 | 1 | T-1 | $1.5\times10^{-3}$ | 2.10 | 0.08 |
| 2 | 1 | 2 | T-1 | $1.5\times10^{-3}$ | 1.88 | 0.06 |
| 3 | 2 | 1 | T-1 | $2.5\times10^{-3}$ | 1.82 | 0.06 |
| 4 | 2 | 2 | T-1 | $2.5\times10^{-3}$ | 1.71 | 0.05 |
| 5 | 3 | 1 | T-1 | $7.5\times10^{-4}$ | 2.19 | 0.14 |
| 6 | 3 | 2 | T-1 | $7.5\times10^{-4}$ | 2.01 | 0.07 |
| 7 | 4 | 1 | T-3 | $1.5\times10^{-3}$ | 2.11 | 0.08 |
| 8 | 4 | 2 | T-3 | $1.5\times10^{-3}$ | 1.90 | 0.06 |
| 9 | 5 | 1 | T-11 | $3.0\times10^{-3}$ | 2.17 | 0.10 |
| 10 | 5 | 2 | T-11 | $3.0\times10^{-3}$ | 1.93 | 0.07 |

TABLE 1-continued

| Transferred image sample No. | Color Photographic material sample No. | Image-receiving element sample No. | Compound of the invention | Amount mol/m² | $D_{max}$ | $D_{min}$ |
|---|---|---|---|---|---|---|
| 11 | 6 | 1 | PT-1 | $1.5 \times 10^{-3}$ | 2.19 | 0.08 |
| 12 | 6 | 2 | PT-1 | $1.5 \times 10^{-3}$ | 2.03 | 0.07 |
| 13 | 7 | 1 | PT-6 | $1.5 \times 10^{-3}$ | 2.21 | 0.09 |
| 14 | 7 | 2 | PT-6 | $1.5 \times 10^{-3}$ | 2.01 | 0.07 |
| 15 | 8 | 1 | PT-7 | $1.5 \times 10^{-3}$ | 2.23 | 0.09 |
| 16 | 8 | 2 | PT-7 | $1.5 \times 10^{-3}$ | 2.02 | 0.07 |
| 17 | 9 | 1 | — | — | 2.37 | 0.23 |
| 18 | 9 | 2 | — | — | 2.27 | 0.14 |
| 19 | 10 | 1 | — | — | 2.24 | 0.16 |
| 20 | 10 | 2 | — | — | 2.20 | 0.12 |

EXAMPLE 3

STORAGE STABILITY TEST ON TRANSFERRED IMAGE SAMPLES

The white ground portions of the transferred image samples obtained in Examples 1 and 2 were irradiated with a 6,000 W xenon lamp for 10 hours to determine the density difference $\Delta D_1$ obtained by the density measurement using blue light (B), green light (G) and red light (R) before and after the irradiation. Using similar xenon lamp, the magenta image portions were also irradiated for 72 hours to determine the image retention ($D/D_0 \times 100\%$) assuming the density before irradiation as $D_0$ and the density after irradiation as D. The same samples were further allowed to stand for 7 days at a temperature of 50° C. under a relative humidity of 80%, to determine the density difference $\Delta D_2$ at the white ground portions (fogged portions). Results obtained are shown in Table 2.

TABLE 2

| Transferred image sample No. | $\Delta D_1$ B | $\Delta D_1$ G | $\Delta D_1$ R | $\Delta D_2$ B | $\Delta D_2$ G | $\Delta D_2$ R | $D/D_0 \times 100$ (%) |
|---|---|---|---|---|---|---|---|
| 1 (The invention) | 0.03 | 0.04 | 0.01 | 0 | 0.02 | 0.02 | 84 |
| 2 (The invention) | 0.01 | 0.02 | 0 | 0 | 0.01 | 0.01 | 85 |
| 3 (The invention) | 0.01 | 0.01 | 0 | 0 | 0 | 0 | 83 |
| 4 (The invention) | 0 | 0 | 0 | 0 | 0 | 0 | 84 |
| 5 (The invention) | 0.05 | 0.07 | 0.02 | 0.02 | 0.03 | 0.02 | 86 |
| 6 (The invention) | 0.02 | 0.02 | 0.01 | 0 | 0 | 0 | 85 |
| 7 (The invention) | 0.03 | 0.04 | 0.01 | 0 | 0.02 | 0.02 | 87 |
| 8 (The invention) | 0.01 | 0.02 | 0 | 0 | 0 | 0 | 84 |
| 9 (The invention) | 0.05 | 0.06 | 0.02 | 0 | 0.02 | 0.02 | 85 |
| 10 (The invention) | 0.01 | 0.02 | 0 | 0 | 0 | 0 | 86 |
| 11 (The invention) | 0.04 | 0.05 | 0.02 | 0 | 0.02 | 0.02 | 84 |
| 12 (The invention) | 0.01 | 0.01 | 0 | 0 | 0 | 0 | 87 |
| 13 (The invention) | 0.04 | 0.05 | 0.02 | 0 | 0.02 | 0.03 | 84 |
| 14 (The invention) | 0.01 | 0.02 | 0 | 0 | 0 | 0 | 83 |
| 15 (The invention) | 0.05 | 0.06 | 0.02 | 0 | 0.02 | 0.02 | 84 |
| 16 (The invention) | 0.01 | 0.01 | 0 | 0 | 0 | 0 | 83 |
| 17 (Comparative Ex.) | 0.34 | 0.25 | 0.14 | 0.07 | 0.09 | 0.06 | 83 |
| 18 (Comparative Ex.) | 0.19 | 0.15 | 0.09 | 0.04 | 0.05 | 0.04 | 86 |
| 19 (Comparative Ex.) | 0.30 | 0.22 | 0.11 | 0.06 | 0.07 | 0.05 | 84 |
| 20 (Comparative Ex.) | 0.18 | 0.15 | 0.08 | 0.04 | 0.05 | 0.03 | 85 |

EXAMPLE 4

The color photographic materials of Examples 1 and 2 were exposed to light in the same manner as in Example 1, and the light-sensitive layer face of the color photographic materials having been subjected to exposure and the polyvinyl chloride-coated face of the image-receiving element 3 shown below were overlapped each other to carry out the thermal evaluation same as in Examples 1 and then the evaluation same as the image evaluation shown in Examples 1 and 3. Results obtained are shown in Table 3.

IMAGE-RECEIVING ELEMENT 3

Photographic baryta paper was coated thereon with a tetrahydrofuran solution of 11% polyvinyl chloride (n=1,100; available from Wako Pure Chemical Industries, Ltd.) so as to have a coating amount of polyvinyl chloride, of 15.0 g/m² to produce image-receiving element 3.

TABLE 3

| Transferred image sample No. | Color photographic material sample No. | $D_{max}$ | $D_{min}$ | $\Delta D_1$ B | $\Delta D_1$ G | $\Delta D_1$ R | $\Delta D_2$ B | $\Delta D_2$ G | $\Delta D_2$ R | $D/D_0 \times 100$ (%) |
|---|---|---|---|---|---|---|---|---|---|---|
| 21 | 1 | 2.28 | 0.10 | 0.01 | 0.05 | 0.01 | 0 | 0 | 0.01 | 81 |
| 22 | 2 | 2.01 | 0.08 | 0 | 0.03 | 0 | 0 | 0 | 0 | 80 |
| 23 | 4 | 2.30 | 0.10 | 0.02 | 0.04 | 0.01 | 0 | 0.01 | 0.02 | 79 |
| 24 | 6 | 2.36 | 0.11 | 0.02 | 0.05 | 0.02 | 0 | 0.02 | 0.02 | 82 |
| 25 | 8 | 2.41 | 0.11 | 0.03 | 0.06 | 0.02 | 0.01 | 0.03 | 0.02 | 78 |
| 26 | 9 | 2.59 | 0.26 | 0.11 | 0.30 | 0.19 | 0.24 | 0.33 | 0.37 | 56 |

TABLE 3-continued

| Transferred image sample No. | Color photographic material sample No. | $D_{max}$ | $D_{min}$ | $\Delta D_1$ B | $\Delta D_1$ G | $\Delta D_1$ R | $\Delta D_2$ B | $\Delta D_2$ G | $\Delta D_2$ R | $D/D_0 \times 100$ (%) |
|---|---|---|---|---|---|---|---|---|---|---|
| 27 | 10 | 2.58 | 0.18 | 0.08 | 0.24 | 0.12 | 0.19 | 0.25 | 0.30 | 60 |

EXAMPLE 5

Coating solutions for the light-sensitive layer, having the same coating solution composition as in Example 1 except that the composition of the dye providing substance dispersion used in Example 1 was replaced by dye providing substance dispersions a to e shown below were each coated on a polyethylene terephthalate film same as that in Example 1 in the same manner as in Example 1 and dried to produce heat-developable color photographic materials, samples Nos. 11 to 15.

On the upper layer of the light-sensitive layer of each of the above color photographic materials, samples Nos. 11, 12 and 13, a protective layer same as the protective layer of Example 1 was provided by coating to produce heat-developable color photographic materials, samples Nos. 16 to 18.

DYE PROVIDING SUBSTANCE DISPERSION A

A dye providing substance dispersion same as that of Example 1 except that the dye providing substance in the dye providing substance dispersion was replaced by exemplary dye providing substance PM-10 (amount for addition: 83 g).

DYE PROVIDING SUBSTANCE DISPERSION B

A dye providing substance dispersion same as that of Example 1 except that the dye providing substance was replaced by exemplary dye providing substance PM-5 (amount for addition: 90 g).

DYE PROVIDING SUBSTANCE DISPERSION C

A dye providing substance dispersion same as that of Example 1 except that the dye providing substance was replaced by exemplary dye providing substance shown below (amount for addition 123 g)

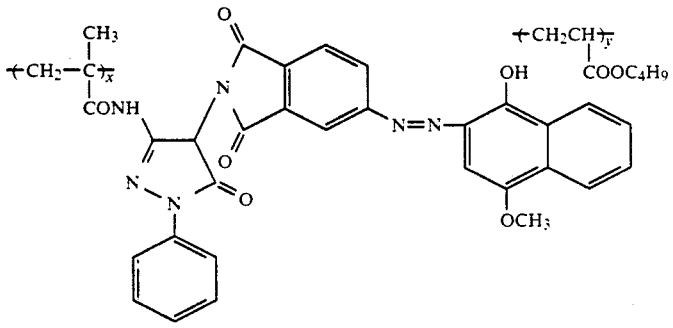

x: 50 wt. %
y: 50 wt. %

DYE PROVIDING SUBSTANCE DISPERSION D

A dye providing substance dispersion same as that in Example 1 except that in the dye providing substance dispersion of Example 1, dye providing substance (PM-7) and further the compound of this invention (T-1; amount for addition: 30 g) were dispersed.

DYE PROVIDING SUBSTANCE DISPERSION E

A dispersion same as dye providing substance dispersion d except that the compound of this invention T-1 in the dye providing substance dispersion d- was replaced by PT-1.

The exposure and heat-development same as those in Example 1 were carried out on color photographic materials, samples Nos. 11 to 18. However, the image-receiving elements used were image-receiving elements 1 and 2. The image evaluation same as that in Examples 1 and 3 was carried out on the resulting transferred images (sample Nos. 28 to 43). Results obtained are shown in Table 4.

TABLE 4

| Transferred image sample No. | Color photographic material sample No. | Dispersion | Image-receiving element sample No. | $D_{max}$ | $D_{min}$ | $\Delta D_1$ B | $\Delta D_1$ G | $\Delta D_1$ R | $\Delta D_2$ B | $\Delta D_2$ G | $\Delta D_2$ R | $D/D_0 \times 100$ (%) |
|---|---|---|---|---|---|---|---|---|---|---|---|---|
| 28 (Comparative) | 11 | a | 1 | 2.11 | 0.07 | 0.29 | 0.21 | 0.10 | 0.06 | 0.07 | 0.05 | 84 |
| 29 (Comparative) | 11 | a | 2 | 1.96 | 0.05 | 0.17 | 0.14 | 0.08 | 0.04 | 0.05 | 0.03 | 85 |
| 30 (Comparative) | 12 | b | 1 | 2.09 | 0.10 | 0.37 | 0.23 | 0.12 | 0.06 | 0.08 | 0.05 | 89 |
| 31 (Comparative) | 12 | b | 2 | 1.84 | 0.06 | 0.17 | 0.15 | 0.08 | 0.04 | 0.05 | 0.03 | 89 |

TABLE 4-continued

| Transferred image sample No. | Color photographic material sample No. | Dispersion | Image-receiving element sample No. | $D_{max}$ | $D_{min}$ | $\Delta D_1$ B | $\Delta D_1$ G | $\Delta D_1$ R | $\Delta D_2$ B | $\Delta D_2$ G | $\Delta D_2$ R | $D/D_0 \times 100$ (%) |
|---|---|---|---|---|---|---|---|---|---|---|---|---|
| 32 (Comparative) | 13 | c | 1 | 2.34 | 0.16 | 0.30 | 0.22 | 0.12 | 0.06 | 0.07 | 0.05 | 88 |
| 33 (Comparative) | 13 | c | 2 | 2.11 | 0.12 | 0.18 | 0.15 | 0.04 | 0.04 | 0.05 | 0.03 | 87 |
| 34 (The invention) | 14 | d | 1 | 1.81 | 0.05 | 0.04 | 0.05 | 0.02 | 0.01 | 0.03 | 0.03 | 87 |
| 35 (The invention) | 14 | d | 2 | 1.74 | 0.04 | 0.02 | 0.03 | 0.01 | 0 | 0.02 | 0.02 | 86 |
| 36 (The invention) | 15 | e | 1 | 1.85 | 0.06 | 0.05 | 0.06 | 0.03 | 0.02 | 0.04 | 0.04 | 85 |
| 37 (The invention) | 15 | e | 2 | 1.77 | 0.04 | 0.03 | 0.03 | 0.02 | 0.01 | 0.02 | 0.02 | 85 |
| 38 (The invention) | 16 | a | 1 | 1.90 | 0.02 | 0.03 | 0.04 | 0.01 | 0 | 0.02 | 0.02 | 88 |
| 39 (The invention) | 16 | a | 2 | 1.72 | 0.01 | 0.01 | 0.02 | 0 | 0 | 0.01 | 0.01 | 87 |
| 40 (The invention) | 17 | b | 1 | 1.88 | 0.06 | 0.03 | 0.03 | 0.01 | 0 | 0.02 | 0.02 | 90 |
| 41 (The invention) | 17 | b | 2 | 1.70 | 0.04 | 0.01 | 0.02 | 0 | 0 | 0.01 | 0.01 | 90 |
| 42 (The invention) | 18 | c | 1 | 2.13 | 0.10 | 0.03 | 0.04 | 0.01 | 0 | 0.02 | 0.03 | 89 |
| 43 (The invention) | 18 | c | 2 | 1.99 | 0.08 | 0.01 | 0.02 | 0 | 0 | 0.01 | 0.01 | 88 |

EXAMPLE 6

On a photographic transparent polyester terephthalate film of 180 μm thick having a subbing layer, a coating solution for the light-sensitive layer, having the composition same as that in Example 1 except that the dye providing substance dispersion was replaced by dye providing substance dispersion d described in Example 5 and the silver halide emulsion was replaced by the red-sensitive silver iodobromide described in Example 1, was coated in a wet film thickness of 70 μm and dried to provide by coating a first light-sensitive layer.

A first intermediate layer having the composition shown below was provided by coating on the first light-sensitive layer.

| | |
|---|---|
| Gelatin | 0.6 g/m² |
| Polyvinyl pyrrolidone | 0.3 g/m² |
| Compound shown below | 0.25 g/m² |
| Methylbenztriazole silver | 0.6 g/m² |
| p-Butoxybenzamide | 1.0 g/m² |
| Compound of this invention (T-1) | 0.3 g/m² |
| 2,4-Dichloro-6-hydroxy-S-triazine sodium | 20 mg/m² |

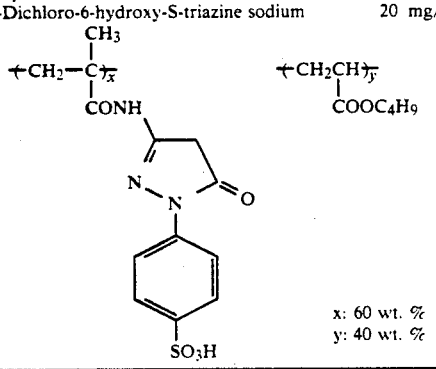

x: 60 wt. %
y: 40 wt. %

A coating solution for the light-sensitive layer, having the composition same as that in Example 1 was coated on the first intermediate layer in a wet film thickness of 50 μm to provide a second light-sensitive layer.

On the second light-sensitive layer was provided by coating a second intermediate layer in which the yellow filter dye (0.2 g/m²) shown below was further added in addition to the composition of the first intermediate layer.

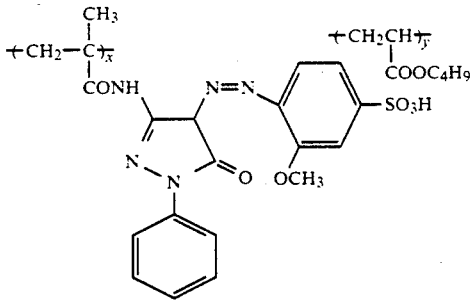

x: 55 wt. %
y: 45 wt. %

On the second intermediate layer, a light-sensitive layer coating solution having the composition same as that in Example 1 except that the dye providing substance dispersion was replaced by dye providing substance dispersion a described in Example 5 and the silver halide emulsion was replaced by the blue-sensitive silver iodobromide silver described in Example 1, was further coated in a wet film thickness of 80 μm and dried to provide a third light-sensitive layer.

On the third light-sensitive layer, a protective layer having the composition shown below was further provided by coating, to obtain a multi-layer color photographic material (sample No. 19).

| | |
|---|---|
| Gelatin | 0.28 g/m² |
| Polyvinyl pyrrolidone | 0.14 g/m² |

-continued

| | |
|---|---|
| $SiO_2$ | 0.36 g/m² |
| Safron | 1.0 g/m² |
| p-Butoxybenzamide | 0.42 g/m² |
| Compound of this invention (T-1) | 0.36 g/m² |

Produced were a multi-layer color photographic material (sample No. 20) same as sample No. 19 except that the compound of this invention T-1 added in the first and second intermediate layers and protective layer of the above multi-layer color photographic material (sample No. 19) was replaced by PT-1, and a multi-layer color photographic material, sample No. 21, same as sample No. 19 except that the compound of this invention (T-1) was not added to the first and second intermediate layers and protective layer of sample No. 19. The resulting color photographic materials, sample Nos. 19 to 21, each were exposed to red light, green light and blue light of 800 CMS, to carry out the heat development same as in Example 1. The image-receiving elements used were image-receiving elements 1 and 2. The transfer density ($D_{max}$, $D_{min}$) of the resulting cyan dye, magenta dye and yellow dye was measured. Results obtained are shown in Table 5. The evaluation same as in Example 3 was further made in respect of the white ground portions. Results obtained are shown in Table 6.

TABLE 5

| Transferred image No. | Color photographic material No. | Image-receiving element No. | $D_{max}$ Cyan | $D_{max}$ Magenta | $D_{max}$ Yellow | $D_{min}$ Cyan | $D_{min}$ Magenta | $D_{min}$ Yellow |
|---|---|---|---|---|---|---|---|---|
| 44 | 19 | 1 | 1.84 | 1.97 | 1.65 | 0.02 | 0.06 | 0.05 |
| 45 | 19 | 2 | 1.78 | 1.93 | 1.60 | 0.02 | 0.06 | 0.04 |
| 46 | 20 | 1 | 1.93 | 2.01 | 1.71 | 0.03 | 0.07 | 0.05 |
| 47 | 20 | 2 | 1.91 | 1.99 | 1.63 | 0.03 | 0.07 | 0.03 |
| 48 | 21 | 1 | 2.01 | 2.11 | 1.83 | 0.08 | 0.12 | 0.09 |
| 49 | 21 | 2 | 1.95 | 2.06 | 1.72 | 0.08 | 0.11 | 0.07 |

TABLE 6

| Transferred image No. | $D_1$ B | $D_1$ G | $D_1$ R | $D_2$ B | $D_2$ G | $D_2$ R |
|---|---|---|---|---|---|---|
| 44 | 0.05 | 0.07 | 0.02 | 0.01 | 0.03 | 0.03 |
| 45 | 0.02 | 0.03 | 0.01 | 0 | 0.01 | 0.01 |
| 46 | 0.05 | 0.08 | 0.02 | 0.01 | 0.03 | 0.03 |
| 47 | 0.02 | 0.03 | 0.01 | 0 | 0.01 | 0.01 |
| 48 | 0.38 | 0.29 | 0.16 | 0.09 | 0.10 | 0.07 |
| 49 | 0.21 | 0.17 | 0.11 | 0.05 | 0.06 | 0.05 |

Examples 1, 2, 4 and 5 show that the fog can be decreased without greatly lowering $D_{max}$ in the color photographic materials comprising the non-light-sensitive layer (protective layer) in which the compound of this invention has been added. Here, the lowering of $D_{max}$ is less in the case when the compound of this invention is a polymer Examples 3, 4 and 5 show that these heat-developable color photographic materials exhibit excellent performance that the generation of stains on the transferred images (in particular, at the low density portions) owing to light, moisture and heat can be remarkably suppressed. The effect of these can be exhibited, as shown in Example 6, also in the multi-layer color photographic materials used for forming a full color image, by adding the compound of this invention in the intermediate layer and the protective layer. Example 4 further shows that the fastness of color images can also be improved when the polyvinyl chloride is used as the image-receiving element. The above effect can be made more remarkable when the image-receiving element containing the compound of this invention and the color photographic material of this invention are used in combination, and the effect of this invention can be exhibited as the lowering of the density $D_{max}$ can be suppressed by controlling the amount of the compound of this invention to be added in the image-receiving element and color photographic material (in particular, the non-light-sensitive layer in the color photographic material).

Example 5 also shows that although the effect of this invention can be exhibited even if the compound of this invention is added in the light-sensitive layer in the color photographic material, undesirable influence to the properties ($D_{max}$, in particular) of the color photographic material may somewhat become greater than the case it is added in the non-light-sensitive layer. Accordingly, more preferred is to add it in the non-light-sensitive layer of the color photographic material.

EXAMPLE 7

PRODUCTION OF HEAT-DEVELOPABLE COLOR PHOTOGRAPHIC MATERIAL NO. 22

On a photographic transparent polyethylene terephthalate film of 180 μm thick having a subbing layer, the coating solution shown below was coated in a wet film thickness of 125 μm, followed by drying to produce a heat-developable color photographic material (sample No. 22)

| (Composition of coating solution) | | |
|---|---|---|
| Organic silver salt dispersion | (prepared in Example 1) | 64 ml |
| Green-sensitive silver iodobromide emulsion solution | (prepared in Example 1) | 30.7 ml |
| Reducing agent solution | (prepared in Example 1) | 38.4 ml |
| Thermal solvent dispersion | (prepared in Example 1) | 94.8 ml |
| Dye providing substance dispersion | (prepared in Example 1) | 101 ml |
| Aqueous 10 wt. % photographic gelatin solution | | 21.1 ml |
| Aqueous 10 wt. % phenylcarbamoyl-introduced gelatin solution | | 27.7 ml |
| Aqueous citric acid solution and water (adjusting the pH of the coating solution to 5.5) | | 89 ml |
| Aqueous 2.5% 2,4-dichloro-6-hydroxy-S-triazine sodium solution | | 13.3 ml |
| Total | | 480 ml |

EXAMPLE 8

PRODUCTION OF IMAGE-RECEIVING ELEMENT

Photographic baryta paper was coated thereon with an ethylene chloride solution of 11% polycarbonate (molecular weight 25,000; L-1250, available from Teijin Chemicals Ltd.) so as to have a coating amount of polycarbonate, of 15.0 g/M$^2$ to produce image-receiving element 4.

Similarly, photographic baryta paper was coated thereon with a tetrahydrofuran solution of 11% polyvinyl chloride (n = 1,100; available from Wako Pure Chemical Industries, Ltd.) so as to have a coating amount of polyvinyl chloride, of 15.0 g/M$^2$ to produce image-receiving element 5.

The compound of this invention as shown in Table 7 was added in the coating solution of the above image-receiving element, and the solution was coated on photographic baryta paper so as to be in the coating amount as shown in Table 7 (coating amounts of polycarbonate and polyvinyl chloride are both 15.0 g/M$^2$), to produce image-receiving elements 6 to 19.

EXAMPLE 9

EVALUATION 1 ON SAMPLES OF IMAGE-RECEIVING ELEMENTS

Color photographic materials obtained in Example 7 were subjected to green color exposure of 800 CMS through a step wedge.

Next, the polymer-coated face of each of the above image-receiving elements (4 to 19) and the light-sensitive layer face of the above color photographic materials having been subjected to the exposure were overlapped each other, and the heat development was carried out for 90 seconds at 150° C., to obtain a transferred magenta image on the dye-receiving layer of the image-receiving element. Maximum density ($D_{max}$) and fog density ($D_{min}$) of the resulting magenta images are shown in Table 7.

TABLE 7

| Image-receiving element No. | Polymer in dye-receiving layer | Compound of the invention | Amount (mol/m$^2$) | $D_{max}$ | $D_{min}$ |
|---|---|---|---|---|---|
| 4 (Comparative Ex.) | Polycarbonate | — | — | 2.24 | 0.16 |
| 5 (Comparative Ex.) | Polyvinyl chloride | — | — | 2.58 | 0.18 |
| 6 (The invention) | Polycarbonate | T-1 | $2.5 \times 10^{-3}$ | 2.14 | 0.10 |
| 7 (The invention) | Polycarbonate | T-1 | $3.5 \times 10^{-3}$ | 2.09 | 0.08 |
| 8 (The invention) | Polycarbonate | T-1 | $5.0 \times 10^{-3}$ | 1.98 | 0.04 |
| 9 (The invention) | Polycarbonate | T-3 | $3.5 \times 10^{-3}$ | 2.04 | 0.09 |
| 10 (The invention) | Polycarbonate | T-11 | $7.0 \times 10^{-3}$ | 2.11 | 0.07 |
| 11 (The invention) | Polycarbonate | T-18 | $1.0 \times 10^{-2}$ | 2.19 | 0.12 |
| 12 (The invention) | Polycarbonate | PT-1 | $3.5 \times 10^{-3}$ | 2.16 | 0.12 |
| 13 (The invention) | Polyvinyl chloride | T-1 | $2.5 \times 10^{-3}$ | 2.47 | 0.10 |
| 14 (The invention) | Polyvinyl chloride | T-1 | $3.5 \times 10^{-3}$ | 2.35 | 0.09 |
| 15 (The invention) | Polyvinyl chloride | T-1 | $5.0 \times 10^{-3}$ | 2.17 | 0.05 |
| 16 (The invention) | Polyvinyl chloride | T-3 | $3.5 \times 10^{-3}$ | 2.37 | 0.10 |
| 17 (The invention) | Polyvinyl chloride | T-11 | $7.0 \times 10^{-3}$ | 2.32 | 0.09 |
| 18 (The invention) | Polyvinyl chloride | T-18 | $1.0 \times 10^{-2}$ | 2.44 | 0.10 |
| 19 (The invention) | Polyvinyl chloride | PT-1 | $3.5 \times 10^{-3}$ | 2.43 | 0.11 |

EXAMPLE 10

EVALUATION 1 ON SAMPLES OF IMAGE-RECEIVING ELEMENTS

The white ground portions of the transferred image samples obtained according to the procedures used in Example 9 were irradiated with a 6,000 W xenon lamp for 10 hours to determine the density difference $\Delta D_1$ obtained by the density measurement using blue light (B), green light (G) and red light (R) before and after the irradiation. Using similar xenon lamp, the magenta image portions were also irradiated for 72 hours to determine the image retention ($D/D_0 \times 100\%$) assuming the density before irradiation as $D_0$ and the density after irradiation as D. The same samples were further allowed to stand for 7 days at a temperature of 50° C. under a relative humidity of 80 %, to determine the density difference $\Delta D_2$ at the white ground portions (fogged portions). Results obtained are shown in Table 8.

TABLE 8

| Image-receiving element No. | $\Delta D_1$ | | | $\Delta D_2$ | | | $D/D_0 \times 100\%$ |
|---|---|---|---|---|---|---|---|
| | B | G | R | B | G | R | |
| 4 (Comparative Ex.) | 0.30 | 0.22 | 0.11 | 0.06 | 0.01 | 0.05 | 84 |
| 5 (Comparative Ex.) | 0.08 | 0.24 | 0.12 | 0.19 | 0.25 | 0.30 | 60 |
| 6 (The invention) | 0.03 | 0.06 | 0.02 | 0 | 0.03 | 0.03 | 88 |
| 7 (The invention) | 0.02 | 0.05 | 0.01 | 0 | 0.01 | 0.01 | 84 |
| 8 (The invention) | 0.01 | 0.04 | 0.01 | 0 | 0 | 0 | 84 |
| 9 (The invention) | 0.02 | 0.05 | 0.01 | 0 | 0.01 | 0.01 | 84 |
| 10 (The invention) | 0.03 | 0.04 | 0.02 | 0 | 0.02 | 0.02 | 85 |
| 11 (The invention) | 0.02 | 0.05 | 0.02 | 0.01 | 0.04 | 0.03 | 85 |
| 12 (The invention) | 0.03 | 0.05 | 0.02 | 0 | 0.02 | 0.01 | 86 |
| 13 (The invention) | 0.02 | 0.07 | 0.01 | 0 | 0 | 0.01 | 86 |
| 14 (The invention) | 0.01 | 0.05 | 0.01 | 0 | 0.01 | 0.01 | 78 |
| 15 (The invention) | 0.01 | 0.04 | 0.01 | 0 | 0 | 0 | 76 |
| 16 (The invention) | 0.01 | 0.05 | 0.01 | 0 | 0.01 | 0 | 86 |
| 17 (The invention) | 0.02 | 0.06 | 0.01 | 0 | 0.02 | 0.04 | 85 |
| 18 (The invention) | 0.02 | 0.07 | 0.02 | 0.01 | 0.03 | 0.05 | 83 |
| 19 (The invention) | 0.03 | 0.07 | 0.02 | 0.01 | 0.03 | 0.04 | 83 |

EXAMPLE 11

STORAGE STABILITY TEST ON SAMPLES OF IMAGE-RECEIVING ELEMENT

Image-receiving elements 6 to 19 were allowed to stand for 3 days at a temperature of 50° C. under a relative humidity of 80%, and thereafter the evaluation on the samples of the image-receiving elements was made in the same manner in Examples 9 and 10 to reveal that there were shown entirely the same performances as those achieved before they were allowed to stand for the test.

The above Examples 8 to 10 show that the fog can be greatly decreased by using the image-receiving element of this invention, surprisingly without causing a lowering of the maximum density so much. Also, the increase in the stains on the images, particularly at the white ground portions, caused by light, temperature and humidity can be greatly suppressed, and there may occur less deterioration of the image density owing to light (good light-fastness). In particular, the light-fastness can be improved in the samples of the image-receiving element in which the polyvinyl chloride was used. Thus, the image-receiving element of this invention can have excellent performances Example 11 further shows that there is no problem in the storage stability of the image-receiving element itself.

We claim:

1. A process for forming an image on a heat-developable color photographic material of the type having a light sensitive silver halide emulsion and a diffusible dye providing substance, which comprises image-wise exposing the photographic material to light, and thereafter carrying out heat-developable processing at a temperature of 80° C. to 200° C. the presence of a compound represented by Formula (1) shown below:

Formula (1)

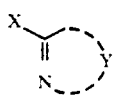

wherein X represents a halogen atom, and Y represents a group of nonmetallic atoms necessary for forming a nitrogen-containing heterocyclic ring bearing on the ring at least one substituent having 6 to 30 carbon atoms, and being a ballast group.

2. The process of claim 1, wherein the compound represented by Formula (1) is at least one of Formulas (A) to (E), (H) and (I):

Formula (A):

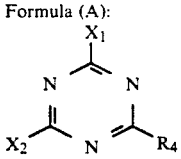

wherein, $X_1$ and $X_2$ each represents a halogen atom, $R_4$ represents a ballast group having 6 to 30 carbon atoms or a polymer residual group, Formula (B):

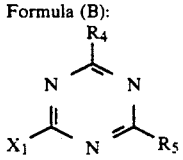

wherein, $X^1$ and $R_4$ are the same as defined in Formula (A), $R_5$ represents a monovalent organic group which may be either a ballast group or a polymer residual group, Formula (C):

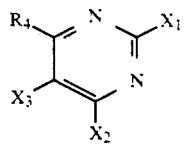

wherein, $X^1$, $X_2$ and $R_4$ are the same as defined in Formula (A), $X_3$ represents a halogen atom, and $X_1$, $X_2$ and $X_3$ may not be all like halogen atoms, Formula (D):

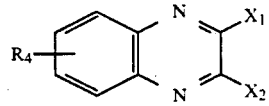

wherein, $X^1$, $X_2$ and $R_4$ are the same as defined in Formula (A),

Formula (E):

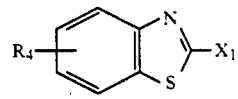

wherein, $X^1$ and $R_4$ are the same as defined in Formula (A),

Formula (H):

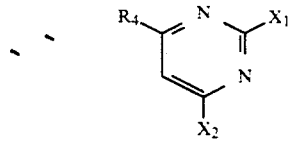

wherein, $X_1$, $X_2$ and $R_4$ are the same as defined in Formula (A),

Formula (I):

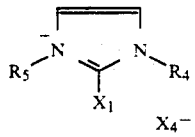

wherein, $X_1$, $R_4$ and $R_5$ are the same as defined in Formula (B) and $X_4^-$ represents an anion.

3. The process of claim 1 wherein said compound represented by Formula (1) is present in an image-receiving element for a diffusion transfer type heat-developable color photographic material.

4. The process of claim 1 wherein said compound represented by Formula (1) is present in an heat-developable light-sensitive material having on a support a light-sensitive silver halide, a dye providing substance, a reducing agent and a binder at least.

5. The process of claim 1, wherein said color photographic material is provided with 0.01 mol to 500 mols per mole of silver halide of an organic silver salt to increase the sensitivity or improve development performance, said silver salt being along chain aliphatic carboxylic acid, a silver salt of a carboxylic acid having a heterocyclic ring, a silver salt of an imino group, a silver compound having a stability constant of 4.5 to 1.0 or a silver salt of imidazolinethione.

6. The process of claim 5, wherein the silver salt is silver laurate, silver myristate, silver palmitate, silver stearate, silver arachidonate, silver behenate, silver α-(1-phenyltetrazolethio)acetate, silver benzoate or silver phthalate.

7. The process of claim 5, wherein the silver salt is a silver salt of 5-methylbenzotriazole or of N-alkylsulfamoylbenzotriazole.

8. The process of claim 2 wherein said compound of formula (1) is selected from the group consisting of compounds having the following definitions:

| Formulas (A) to (I) | $R_4$ | $R_5$ | $R_6$ | $X_1$ | $X_2$ | $X_3$ | $X_4$ |
|---|---|---|---|---|---|---|---|
| (B) | $C_4H_9$— | $C_4H_9$— | — | —Cl | — | — | — |
| (B) | $C_4H_9$— | $C_{10}H_{21}$— | — | —Cl | — | — | — |
| (C) | $C_{10}H_{21}NH$— | — | — | —Cl | —Cl | —Cl | — |
| (C) | $C_{10}H_{21}NH$— | — | — | —F | —F | —Cl | — |
| (D) | 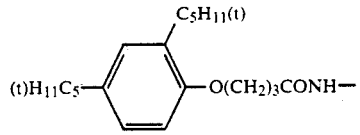 | — | — | —Cl | —Cl | — | — |
| (D) | 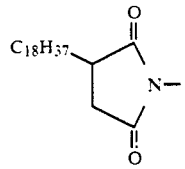 | — | — | —Cl | —Cl | — | — |
| (D) | $C_{16}H_{33}CH(SO_3H)CONH$— | — | — | —Cl | —Cl | — | — |
| (E) | $C_{17}H_{35}CONH$— | — | — | —Cl | — | — | — |
| (E) | $C_{18}H_{37}CH(CH_2COOH)CONH$— | — | — | —Cl | — | — | — |
| (B) | $C_{10}H_{21}NH$— | $NH_2$— | — | —Cl | — | — | — |
| (I) | $C_{10}H_{21}$— | $C_{10}H_{21}$— | — | —Cl | — | — | —Cl |
| (A) | $C_{10}H_{21}NH$— | — | — | —Cl | —Cl | — | — |
| (A) | $C_6H_{13}NH$— | — | — | —Cl | —Cl | — | — |
| (A) | $(C_8H_{17})_2N$— | — | — | —Cl | —Cl | — | — |
| (A) | $(C_4H_9)_2N$— | — | — | —Cl | —Cl | — | — |
| (A) | $C_{16}H_{33}NH$— | — | — | —Cl | —Cl | — | — |
| (A) | 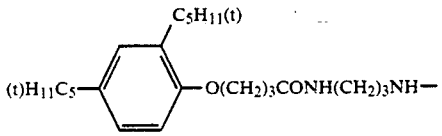 | — | — | —Cl | —Cl | — | — |
| (A) | 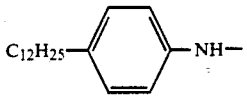 | — | — | —Cl | —Cl | — | — |
| (A) | 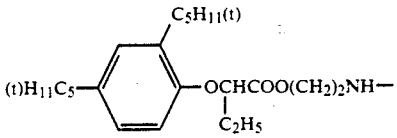 | — | — | —Cl | —Cl | — | — |

$R_4$ (A): $C_5H_{11}(t)$; (t)$H_{11}C_5$; $O(CH_2)_3CONH(CH_2)_3NH$—

$R_4$ (A): $C_{12}H_{25}$; NH—

$R_4$ (A): $C_5H_{11}(t)$; (t)$H_{11}C_5$; $OCH(C_2H_5)COO(CH_2)_2NH$—

-continued
| Formulas (A) to (I) | $R_4$ | $R_5$ | $R_6$ | $X_1$ | $X_2$ | $X_3$ | $X_4$ |
|---|---|---|---|---|---|---|---|
| (A) | 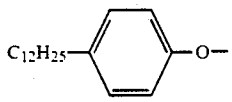 | — | — | —Cl | —Cl | — | — |
| (A) | 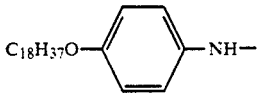 | — | — | —Cl | —Cl | — | — |
* * * * *